US008820889B2

(12) United States Patent
Hirato

(10) Patent No.: US 8,820,889 B2
(45) Date of Patent: Sep. 2, 2014

(54) MAINTENANCE METHOD OF LIQUID EJECTION HEAD AND LIQUID EJECTION APPARATUS

(75) Inventor: Katsuyuki Hirato, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 296 days.

(21) Appl. No.: 12/569,645

(22) Filed: Sep. 29, 2009

(65) Prior Publication Data

US 2010/0079540 A1 Apr. 1, 2010

(30) Foreign Application Priority Data

Sep. 30, 2008 (JP) ..... 2008-253430

(51) Int. Cl.
*B41J 2/165* (2006.01)

(52) U.S. Cl.
CPC ..... *B41J 2/16585* (2013.01); *B41J 2/16535* (2013.01)
USPC ..... 347/33

(58) Field of Classification Search
None
See application file for complete search history.

(56) References Cited

U.S. PATENT DOCUMENTS

| | | | | |
|---|---|---|---|---|
| 4,357,614 | A * | 11/1982 | Tamai | 347/47 |
| 6,106,097 | A | 8/2000 | Otani et al. | |
| 6,257,701 | B1 | 7/2001 | Otani et al. | |
| 6,918,666 | B2 * | 7/2005 | Sekiya | 347/107 |
| 2003/0058301 | A1 | 3/2003 | Sekiya | |
| 2007/0165063 | A1 | 7/2007 | Horie | |
| 2008/0211862 | A1 * | 9/2008 | Umeda | 347/33 |
| 2009/0073221 | A1 * | 3/2009 | Yoda et al. | 347/33 |

FOREIGN PATENT DOCUMENTS

| | | | |
|---|---|---|---|
| JP | 56-135075 | A | 10/1981 |
| JP | 5-293973 | A | 11/1993 |
| JP | 2003-175617 | A | 6/2003 |
| JP | 2007-190818 | A | 8/2007 |
| JP | 2007-276165 | A | 10/2007 |

* cited by examiner

*Primary Examiner* — Alejandro Valencia
(74) *Attorney, Agent, or Firm* — Birch, Stewart, Kolasch & Birch, LLP

(57) ABSTRACT

A maintenance method of a liquid ejection head including a nozzle forming surface where a plurality of nozzles having a polygonal planar shape including a plurality of corners which each have two sides and an angle between the two sides are formed, includes the step of causing a relative movement of a sweep member and the head so as to sweep the nozzle forming surface of the liquid ejection head in such a manner that the sweep member is moved in a direction making an angle within π/8 radian with respect to a direction in which any of the sides extends.

20 Claims, 19 Drawing Sheets

FIG.3

| NOZZLE SHAPE | NOZZLE SIZE | WIPING ANGLE $\alpha$ (rad) | INK DRAW-OUT RATE (%) | VERDICT |
|---|---|---|---|---|
| CIRCULAR | 25 $\mu$m (DIAMETER) | — | 0.2 | - |
| SQUARE | 14 $\mu$m (ONE SIDE) | $\pi/4$ | 100 | Poor |
| SQUARE | 14 $\mu$m (ONE SIDE) | $3\pi/16$ | 90 | Poor |
| SQUARE | 14 $\mu$m (ONE SIDE) | $\pi/8$ | 20 | Good |
| SQUARE | 14 $\mu$m (ONE SIDE) | $\pi/16$ | 1 | Good |
| SQUARE | 14 $\mu$m (ONE SIDE) | 0 | 0.1 | Good |

FIG.8

| WIPING DIRECTION $\alpha$ (rad) | WIPING SPEED v (mm/s) | INK DRAW-OUT RATE (%) | VERDICT |
|---|---|---|---|
| $\pi/8$ | 400 | 100 | Poor |
| $\pi/8$ | 200 | 20 | Poor |
| $\pi/8$ | 100 | 10 | Good |
| $\pi/8$ | 10 | 1 | Good |
| $\pi/8$ | 1 | 0.1 | Good |
| 0 | 200 | 5 | Good |
| 0 | 100 | 0.1 | Good |
| 0 | 10 | 0 | Good |

MAINTENANCE METHOD OF LIQUID EJECTION HEAD AND LIQUID EJECTION APPARATUS

BACKGROUND OF THE INVENTION

1. Field of the Invention

The present invention relates to a maintenance method of liquid ejection head and a liquid ejection apparatus, and more particularly to maintenance technique of an ink ejection surface of a liquid ejection head of an inkjet type.

2. Description of the Related Art

Methods for printing high-quality images at high speed include: offset printing, relief printing, gravure printing methods, and the like. However, these methods are not suitable for printing small lots since they require time to manufacture the printing plate. On the other hand, an inkjet method has been proposed as a high-speed digital printing method, amidst increasing demands in recent years for digital printing having high-quality and high-speed characteristics. An inkjet method ejects ink from very fine holes (nozzles), and requires improvement in the accuracy of nozzle positions in order to achieve high image quality. In the related art, nozzles having a circular planar shape are manufactured by laser boring, or the like, but if nozzles are manufactured by this method, then variations in the nozzle shape occur. In response to this, a nozzle forming method which employs wet etching of silicon monocrystal makes it possible to manufacture nozzles of high accuracy, but due to problems of the crystalline structure, nozzles having a quadrangular planar shape are formed (see Japanese Patent Application Publication No. 56-135075).

Furthermore, in a normal inkjet recording apparatus, ink is pushed out from the inkjet head at periodic intervals as a countermeasure to head blockages, and wiping is carried out in order to clean the nozzle surface of the head (Japanese Patent Application Publication No. 5-293973).

However, in the case of square nozzles which are formed using wet etching of silicon monocrystal, ink is liable to spill over from the corner portions when wiping, and deviation of the flight of the ink occurs with a certain probability in nozzles where ink has spilled and in nozzles where the spilled ink has become attached. Furthermore, since dirt is liable to gather in the corner portions of nozzles which have a planar shape including corners, then the nozzle shape becomes asymmetrical due to dirt which collects in the corner portions, and ejection abnormalities such as deviation of the direction of ejection and ejection failures, and the like, are liable to occur. There has been no effective maintenance method for high-precision nozzles formed by wet etching of silicon which has resolved these problems.

FIG. 19A is a plan diagram illustrating an enlarged view of a portion of a nozzle surface 202A of an inkjet head (head) 202 with a nozzle 200 having a substantially square planar shape. As illustrated in FIG. 19A a plurality of nozzles 200 are disposed in a matrix configuration in the nozzle surface 202A of the head 202. When the nozzle surface 202A of the head 202 illustrated in FIG. 19A is wiped with a blade 204, if wiping is performed following the diagonal direction of the nozzles (as indicated by the arrow in FIG. 19A), then dirt is liable to collect in the corner portions 200A of the nozzles 200 as described above.

FIG. 19B illustrates a schematic view of the state of the nozzle surface 202A after the completion of wiping. As illustrated in FIG. 19B, ink droplets 206 and dirt 208 drawn out from the corner portions 200A of the nozzles 200 adhere to the nozzle surface. Adhering matter of this kind on the nozzle surface 202A may affect the ink ejection characteristics and give rise to ejection abnormalities.

SUMMARY OF THE INVENTION

The present invention has been contrived in view of these circumstances, an object thereof being to provide a maintenance method of liquid ejection head and a liquid ejection apparatus that enable a desirable maintenance processing (treatment) of an inkjet head comprising nozzles having a polygonal planar shape such as a quadrangle.

In order to attain an object described above, one aspect of the present invention is directed to a maintenance method of a liquid ejection head including a nozzle forming surface where a plurality of nozzles having a polygonal planar shape including a plurality of corners which each have two sides and an angle between the two sides are formed, the maintenance method comprising the step of causing a relative movement of a sweep member and the liquid ejection head so as to sweep the nozzle forming surface of the liquid ejection head with the sweep member in such a manner that the sweep member is relatively moved in a sweeping direction making an angle within $\pi/8$ radian with respect to an extending direction in which any of the sides extends.

Another aspect of the present invention is directed to a liquid ejection apparatus comprising: a liquid ejection head that includes a nozzle forming surface where a plurality of nozzles having a polygonal planar shape including a plurality of corners which each have two sides and an angle between the two sides are formed; a sweep member for sweeping the nozzle forming surface of the liquid ejection head; and a movement device that causes a relative movement of the sweep member and the liquid ejection head in a sweeping direction making an angle within $\pi/8$ radian with respect to an extending direction in which any of the sides extends in such a manner that the sweep member sweeps the nozzle forming surface.

According to the present invention, since the sweep member is moved in a direction within $\pi/8$ radian with respect to a direction of a side of a nozzle during a sweep of the nozzle forming surface of a liquid ejection head having polygonal nozzles, it is effectively prevented that ink is drawn out of a corner of each nozzle and extraneous matter stays in a corner of each nozzle.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 3 is a table showing the relationship between the wiping direction and the ink draw-out rate;

FIG. 8 is a table showing the relationship between the wiping speed and the ink draw-out rate;

DETAILED DESCRIPTION OF THE PREFERRED EMBODIMENTS

Description of Wiping Method

Figure 1A:
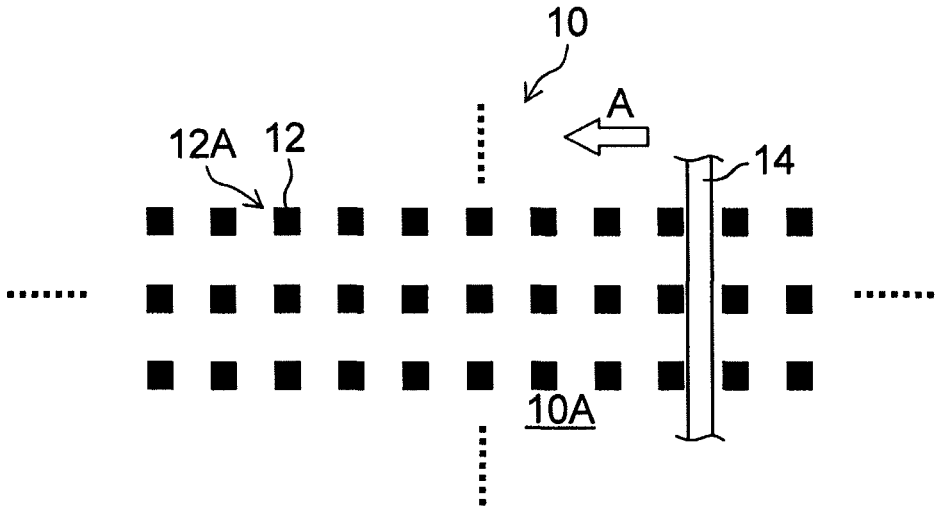
FIGS. 1A and 1B are diagrams illustrating a wiping method according to an embodiment of the present invention.
Figure 1B:
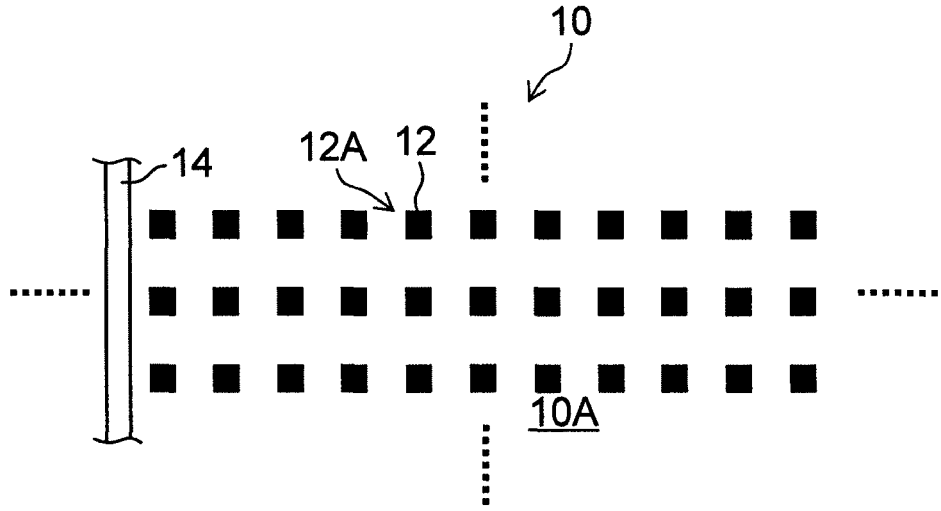

FIGS. 1A and 1B are approximate plan diagrams of an inkjet head (head) 10 employed in an inkjet recording apparatus as viewed from the nozzle forming surface 10A, and depict a portion of a nozzle forming surface 10A. A plurality of nozzles 12 having a substantially square planar shape are arranged in a matrix configuration (see FIGS. 14A to 14D) on the nozzle forming surface 10A of the inkjet head 10 illustrated in FIGS. 1A and 1B. Furthermore, as described in detail hereinafter, the head 10 is a full line type head and the nozzles 12 are arranged therein through a length corresponding to the full width of the paper (the length of the paper in the direction perpendicular to the paper conveyance direction).

A silicon monocrystal substrate is used for the nozzle plate of the head 10 and the nozzles 12 having a substantially quadrangular planar shape due to the crystalline structure of the silicon monocrystal substrate are formed by wet etching in the nozzle plate.

The nozzle forming surface 10A of the inkjet head 10 is wiped by a blade 14 in order to remove adhering ink and adhering matter such as dirt, paper dust, and the like. Wiping is a process of removing adhering matter on the nozzle forming surface 10A by causing the blade 14 to move in a state of contact or close proximity with the nozzle forming surface 10A.

Figure 2:
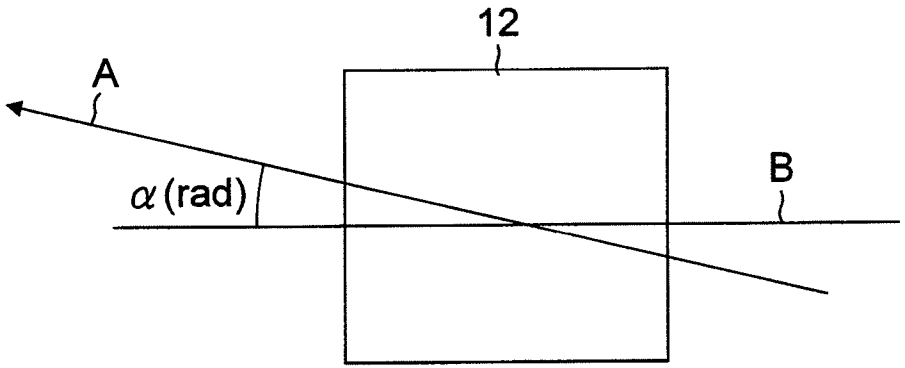
FIG. 2 is a diagram illustrating the relationship between a wiping direction and the direction of the sides of the nozzles.

In the wiping illustrated in the present example, the direction of movement of the blade 14 (indicated by the arrow labelled with reference symbol A in FIG. 1A) is substantially parallel to the direction of the sides of the nozzles 12 (illustrated in detail in FIG. 2). As described in the "Description of the Related Art" above, when wiping is performed by moving a blade 14 in the diagonal direction of nozzles 12 having a substantially quadrangular planar shape, there are possibilities that ink is drawn out from the nozzles 12 onto the nozzle forming surface 10A and ink is liable to collect in the corner portions 12A of the nozzles 12, but these problems are resolved if the blade 14 is moved following the side direction of the nozzles 12 as in the present embodiment. FIG. 1B illustrates a state after the blade 14 has passed.

Description of Direction of Movement of Blade

Next, the direction of movement of the blade 14 (wiping direction) in the wiping method of the present embodiment will be described. FIG. 2 illustrates the relationship between the wiping direction A and the side direction B of the nozzles 12. Taking the angle of the wiping direction A with respect to the side direction B (the wiping angle) as $\alpha$ (rad), as illustrated in FIG. 2, the ink draw-out rate was determined respectively for the wiping angle $\alpha$ values of $\pi/4$, $(3\times\pi)/16$, $\pi/8$, $\pi/16$ and 0.

In order to determine the ink draw-out rate, wiping was performed simultaneously for a plurality of nozzles 12 by the blade 14, the nozzle forming surface 10A was observed in enlarged view with a microscope, and the like, and it was confirmed whether or not ink was present in the periphery of the nozzles 12 where wiping had been performed. The ink draw-out rate is an index expressed as the ratio (%) of the number of nozzles having ink present about the periphery thereof with respect to the number of nozzles where wiping has been performed.

FIG. 3 is a table showing the relationship between the wiping angle $\alpha$ and the ink draw-out rate. The planar shape of the nozzles 12 used to determine the ink draw-out rate was square, and the length of each nozzle side was 14 μm. For the purpose of comparison, FIG. 3 indicates ink draw-out rates for nozzles which have a circular planar shape of diameter 25 μm (a circular shape having approximately the same surface area as a square shape with 14 μm sides).

As illustrated in FIG. 3, if the wiping angle $\alpha$ is $\pi/8$, then the ink draw-out rate is 20%, and the drawing out of the ink is restricted. Furthermore, if the wiping angle $\alpha$ is $\pi/16$ or less, then the ink draw-out rate is 1% or lower and the drawing out of the ink is restricted even more effectively. Moreover, if the wiping angle $\alpha$ is 0 (in other words, if the direction of movement A of the blade 14 is parallel to the side direction B of the nozzles 12), then there is no drawing out of the ink, which can be regarded as most desirable. If the wiping angle $\alpha$ is 0, then the ink draw-out rate is similar to that in the case of nozzles which have a circular planar shape.

On the other hand, if the wiping angle $\alpha$ is $(3\times\pi)/16$ or $\pi/4$ (the direction of movement of the blade 14 is parallel to the diagonal of the nozzles 12), then the ink draw-out rate is 90% or 100%, which indicates that drawing out of ink occurs with an extremely high probability.

Consequently; by setting the wiping angle $\alpha$ to $\pi/8$ or lower, and more desirably, $\pi/16$ or lower, it is possible to suppress drawing out of the ink from the nozzles 12 effectively, and by setting the wiping angle to 0, it is possible to prevent drawing out of the ink.

If ink is drawn out from a nozzle, then the ink thus drawn out moves with the blade 14 and may enter into other nozzles. In order to prevent this kind of infiltration of drawn out ink into other nozzles, the wiping direction A is desirably staggered with respect to the direction of arrangement of the nozzles 12.

Figure 4A:
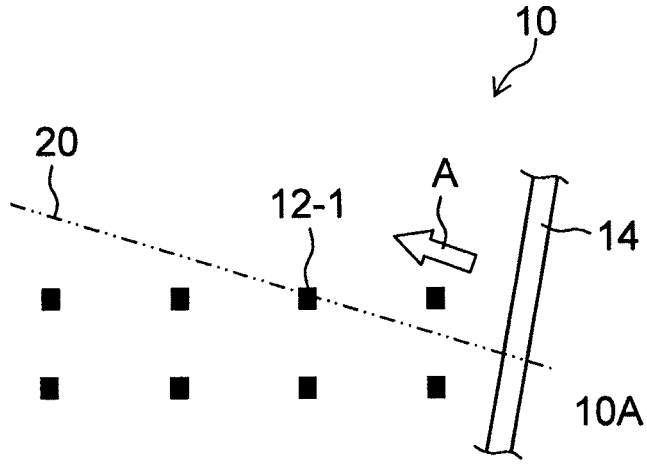
FIGS. 4A and 4B are diagrams illustrating a further example of the wiping direction illustrated in FIG. 2.

As illustrated in FIG. 4A, if the straight line 20 drawn in the parallel direction to the wiping direction A passes through the center of the nozzle 12-1, then by setting the wiping direction A to a direction in which no other nozzles are present on this straight line 20, infiltration of ink drawn out from one nozzle into another nozzle can be prevented. In other words, the wiping direction A is desirably set to a direction parallel to the straight line 20 which is determined in such a manner that no other nozzles are present on the straight line passing through the center of nozzle 12-1. More specifically, the wiping direction A is set in such a manner that the straight line 20 parallel to the wiping direction A passes through the center of one nozzle but does not pass through the center of any other nozzle.

Figure 4B:
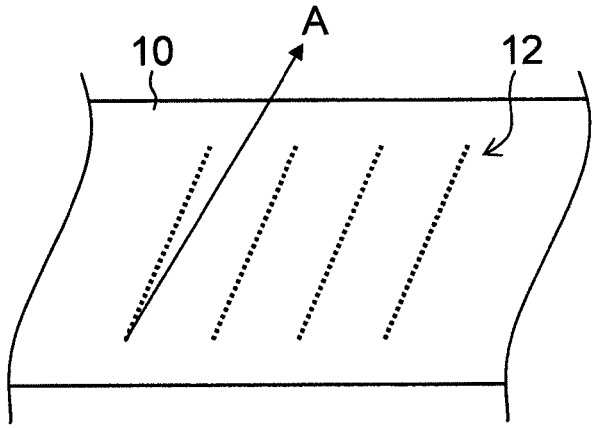

FIG. 4B illustrates the wiping direction A in a case where the nozzles 12 are arranged in a matrix configuration. In a head 10 where the nozzles 12 are arranged in a matrix configuration following a row direction along the main scanning direction and a column direction which is an oblique direction forming a prescribed angle with respect to the sub-scanning direction, the wiping direction A is set as an oblique direction with respect to the column direction.

Figure 5:
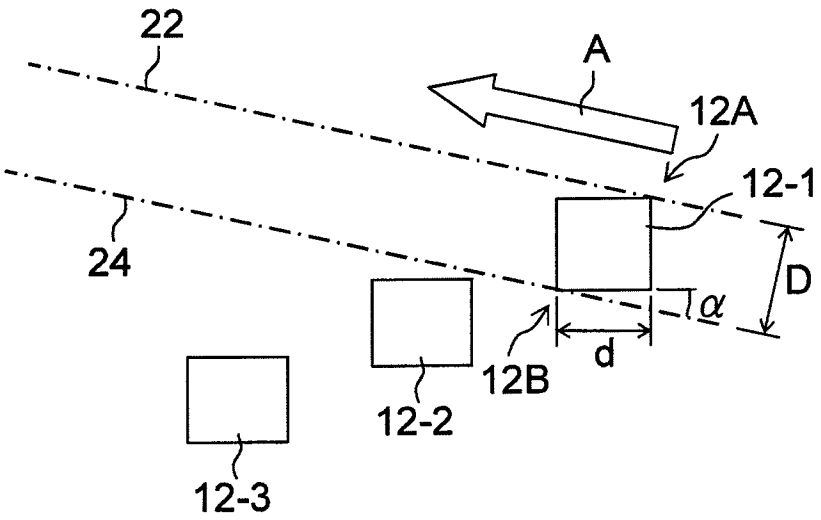
FIG. 5 is a diagram illustrating the details of the wiping direction in FIGS. 4A and 4B.

FIG. 5 is a diagram illustrating an example of a more desirable wiping direction A. As illustrated in FIG. 5, a wiping direction A which is set so as to avoid overlap with other nozzles 12-2, 12-3, and so on, over the full width D of the nozzles, can be regarded as most desirable. More specifically, since only one nozzle 12-1 is disposed and other nozzles 12-2 and 12-3 are not disposed in the region parallel to the wiping direction A corresponding to the full width D of the nozzle 12-1 in the wiping direction (namely the wiping region corresponding to the nozzle 12-1 between the straight line 22 in the parallel direction to the wiping direction A passing through corner 12A and the straight line 24 in the parallel direction to the wiping direction A passing through corner 12B), then even if the ink drawn out from nozzle 12-1 moves with the blade 14 (see FIG. 4B), it does not pass through the position of the other nozzles 12-2, 12-3, and so on, and therefore the ink drawn out from the nozzle 12-1 never becomes mixed into the other nozzles 12-2, 12-3, and so on. Taking the length of one side of the nozzle 12-1 to be d, the full width D of the nozzle 12-1 illustrated in FIG. 5 is expressed as $D=d\times(\cos\alpha+\sin\alpha)$.

However, depending on the nozzle arrangement density and arrangement pattern, there may be cases where the wiping direction A illustrated in FIG. 5 does not exist. In cases such as this, the wiping direction is desirably determined as illustrated in FIG. 6.

Figure 6:
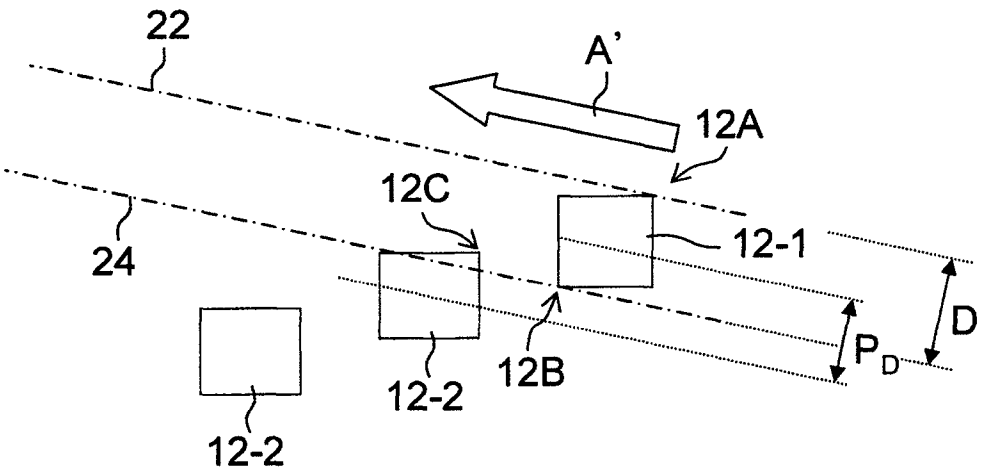
FIG. 6 is a diagram illustrating a further example of the wiping direction illustrated in FIG. 5.

The wiping direction A' illustrated in FIG. 6 is determined in such a manner that the centers of the nozzles 12-1 and 12-2 are distanced by ½ or more of the width D in the wiping direction A'.

In other words, the component $P_D$ of the distance between the center of the nozzle 12-1 and the center of the nozzle 12-2 in the direction perpendicular to the wiping direction A' is set to a distance that exceeds ½ of the full width D of the nozzle 12-1 in the wiping direction A' ($P_D>D/2$). In other words, the wiping direction A' is set in such a manner that although one portion of the nozzle 12-2 including the corner 12C is positioned within the wiping region corresponding to the nozzle 12-1, the center of the nozzle 12-2 is not positioned in the wiping region corresponding to the nozzle 12-1.

If the wiping direction A (A') is set in such a manner that a portion of the blade 14 which has made contact with a certain nozzle does not pass over another nozzle, by setting the wiping direction A (A') as described with reference to FIGS. 4A and 4B to FIG. 6, then ink which has been drawn out from one nozzle never enters into another nozzle.

To change the wiping direction A (A'), a composition which allows the head 10 and blade 14 to be rotated relatively may be adopted. For example, it is possible to provide a rotating mechanism which rotates the blade 14 in a range from 0 to $\pi/4$ in a plane parallel to the nozzle forming surface 10A. Of course, it is possible to fix the blade 14 and rotate the head 10 in a plane parallel to the nozzle forming surface 10A, or to rotate both the head 10 and the blade 14.

This kind of adjustment of the wiping direction is carried out appropriately at the initial start up of the apparatus (initial adjustment) and in accordance with the presence or absence of wiping abnormalities during maintenance.

Description of Wiping Speed

Figure 7A:
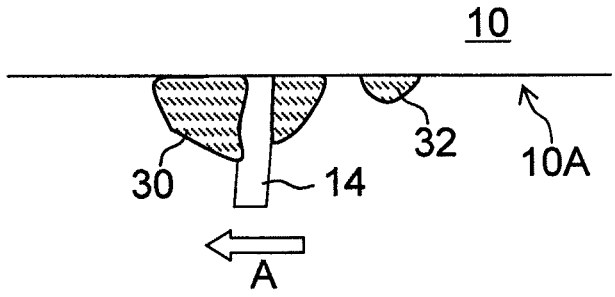
FIGS. 7A and 7B are diagrams illustrating the wiping speed.

Next, the speed of movement of the blade 14 (wiping speed) will be described. If the wiping speed exceeds a prescribed speed, then although it is possible to shorten the time of the wiping process, there is a possibility that sweeping non-uniformities arise. As illustrated in FIG. 7A, a portion of ink 30 which is in contact with the blade 14 separates off and this separated ink 32 is left on the nozzle forming surface 10A.

Figure 7B:
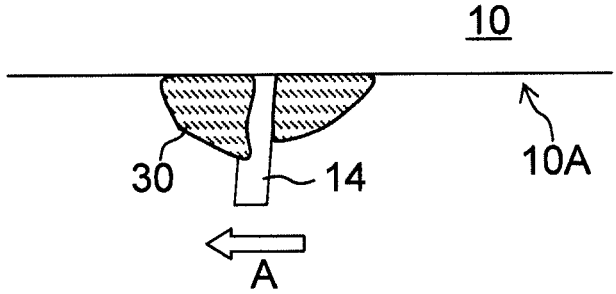

On the other hand, by setting the wiping speed to a prescribed speed or lower, as illustrated in FIG. 7B, the ink which is in contact with the blade 14 does not separate and it is possible to eliminate ink adhering to the nozzle forming surface 10A.

FIG. 8 is a table showing the relationship between the wiping speed v (mm/s) and the ink draw-out rate (%). In FIG. 8, the ink draw-out rate described above was calculated at wiping speeds v being 10, 100, 200 and 400. Furthermore, the difference between using wiping angles $\alpha$ (rad) of 0 and $\pi/8$ was also investigated.

As illustrated in FIG. 8, if the wiping angle $\alpha$ is $\pi/8$ (the maximum value in the permitted range), provided that the wiping speed is 100 (mm/s) or lower, then the ink draw-out rate is 10% or less and drawing out of the ink is suppressed. On the other hand, if the wiping speed is 200 (mm/s) and 400 (mm/s), then the ink draw-out rate is respectively 20% and 100%, and thus drawing out of ink occurs with a high probability. If the wiping angle $\alpha$ is 0, then provided that the wiping speed is 200 (mm/s) or lower, the ink draw-out rate is 5% or lower and thus it can be regarded that drawing out of ink is effectively prevented (or suppressed).

In other words, considering a case where the wiping angle $\alpha$ is a maximum, drawing out of ink is suppressed if the wiping speed v is set to 100 (mm/s) or lower.

Relationship Between Wiping Direction and Paper Conveyance Direction

Next, the relationship between the wiping direction and the paper conveyance direction will be described. In image recording using a single pass method employing a full line type head, non-uniformities in the direction parallel to the paper conveyance direction are readily visible. For example, if deviation occurs in the direction of ejection of the ink in a particular nozzle, then banding following the paper conveyance direction occurs, and in the overall image, this banding is visible as non-uniformity in substantially the perpendicular direction to the paper conveyance direction.

When wiping is carried out in a direction perpendicular to the paper conveyance direction, then if extraneous matter such as ink enters into a particular corner of a nozzle located on a diagonal close to the wiping direction, deviation in the flight of the ink in the direction perpendicular to the paper conveyance direction becomes liable to occur and non-uniformities in the direction perpendicular to the paper conveyance direction can readily arise.

On the other hand, when wiping is carried out in a direction parallel to the paper conveyance direction, then if extraneous matter such as ink has entered into a particular corner of a nozzle located on a diagonal close to the wiping direction, deviation in the flight of the ink in the direction parallel to the paper conveyance direction becomes liable to occur and therefore non-uniformities in the direction perpendicular to the paper conveyance direction do not arise. Consequently, by carrying out wiping within a prescribed angular range in respect of the side direction which is substantially parallel to the paper conveyance direction, using a blade having a length corresponding to the length of the head in the longitudinal direction which is substantially perpendicular to the paper conveyance direction, the occurrence of non-uniformities in the direction perpendicular to the paper conveyance direction is reduced in comparison with a case where wiping is carried out along the longitudinal direction of the head which is substantially perpendicular to the paper conveyance direction.

The occurrence of the non-uniformities described above is a phenomenon which can occur even in the case of image recording based on a serial method which uses a serial scanning head having a plurality of nozzles in the sub-scanning direction, and in such cases, the wiping direction should be set to a direction substantially parallel to the main scanning direction.

According to the wiping method having the composition described above, when wiping is carried out with respect to the nozzle forming surface 10A of a head 10 comprising nozzles 12 having a quadrangular planar shape, the blade 14 is moved following a wiping direction A set in a direction substantially parallel to the side direction B of the nozzles 12 (within a range of $\pm\pi/8$ radian), and therefore drawing out of the ink from the nozzles 12 is prevented and infiltration of extraneous matter into the corners of the nozzles 12 is also prevented.

Furthermore, since the wiping direction A is set in such a manner that the centers of other nozzles are not present within a prescribed region including a straight line parallel to the wiping direction A which passes through the center of a particular nozzle, then ink which has been drawn out during wiping from a particular nozzle is prevented from becoming mixed into the other nozzles.

Moreover, the wiping speed is desirably set to 100 (mm/s) or lower and the wiping direction A is desirably set substantially parallel to the paper conveyance direction.

In the present embodiment, nozzles having a quadrangular planar shape are described, but the present embodiment of the invention can be applied to nozzles with a planar shape having at least one corner and two sides forming either side of the corner, and more specifically, the present embodiment can be applied to nozzles having a polygonal planar shape, such as a triangular, pentagonal or hexagonal shape, or the like.

There are no particular restrictions on the material of the blade 14 employed in embodiments of the present invention, but silicone rubber and fluorine rubber can be suitably used. Furthermore, it is also possible to use porous sponge, inorganic material or cloth. Moreover, there are no particular restrictions on the size of the nozzles 12 to which embodiments of the present invention can be applied, but it can be applied to nozzles having a size of approximately 100 ($\mu m^2$) to 400 ($\mu^2$).

Application Example

Next, an application example of an embodiment of the present invention will be described. In the application example described below, parts which are the same as or similar to the drawings described previously are labelled with the same reference numerals and further explanation thereof is omitted here.

Figure 9:
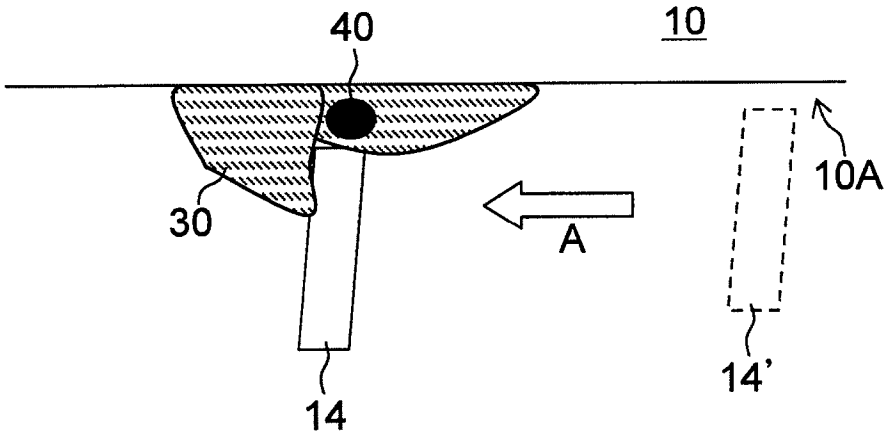
FIG. 9 is a diagram illustrating a wiping method according to a first application example.

FIG. 9 is an illustrative diagram illustrating a schematic view of a wiping method relating to a first application example, and depicts a view of the head 10 in a direction perpendicular to the wiping direction A. In the wiping relating to the first application example, the nozzle forming surface 10A of the head 10 and the blade 14 do not make contact with each other and the blade 14 is moved while maintaining a state of non-contact. In FIG. 9, the blade at the start of wiping is depicted by the dotted lines and labelled with reference numeral 14'.

By setting a non-contact state between the blade 14 and the nozzle forming surface 10A, dirt 40 adhering to the nozzle forming surface 10A is not pushed into the nozzles 12 and furthermore, the dirt 40 moves together with the ink 30.

Figure 10:
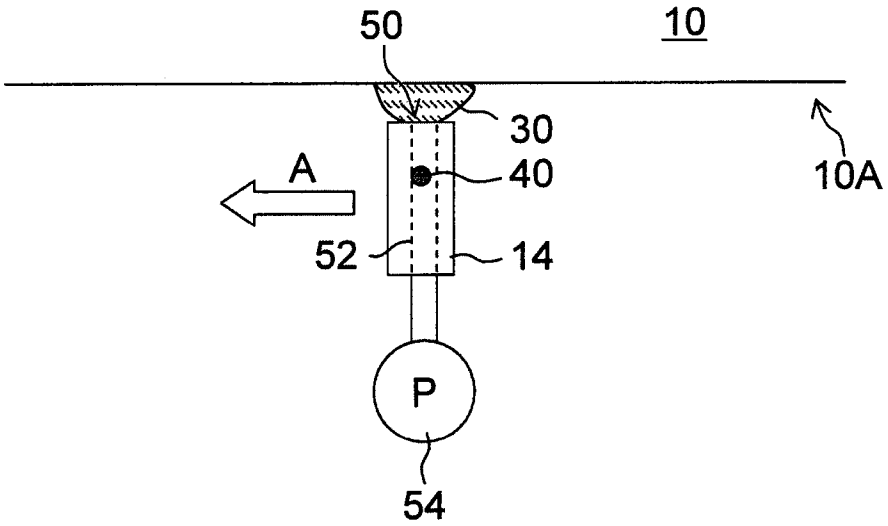
FIG. 10 is a diagram illustrating a wiping method according to a second application example.

FIG. 10 is an illustrative diagram illustrating a composition relating to a second application example, and depicts a view of the head 10 in a direction perpendicular to the wiping direction A. As illustrated in FIG. 10, in the second application example, a plurality of suction holes 50 are provided in the front tip portion of the blade 14, and a flow channel 52 connecting to respective suction holes 50 is also provided, in addition to which the flow channel 52 is connected to a pump 54 provided externally. The plurality of suction holes 50 provided in the front tip portion of the blade 14 are arranged along the longitudinal direction of the blade 14.

By wiping while also suctioning from the suction holes 50 by operating the pump 54 to generate negative pressure in the suction holes 50, it is possible to recover the ink 30 and dirt 40 adhering to the nozzle forming surface 10A via the suction holes 50 and the flow channel 52. Desirably, the blade 14 does not make contact with the nozzle forming surface 10A. Furthermore, although not illustrated in the drawings, the planar shape of the suction holes 50 may be circular or it may be quadrangular. It is possible to link together a plurality of suction holes to form a unified suction hole.

Since the ink and extraneous matter adhering to the nozzle forming surface 10A is recovered simultaneously with wiping by providing a suctioning structure in the blade 14 in this way, then infiltration of ink and extraneous matter into the nozzles 12 from the nozzle forming surface 10A is prevented.

Example of Apparatus Composition

Next, an example of the composition of an inkjet recording apparatus to which the wiping method described above is applied will be explained.

Figure 11:
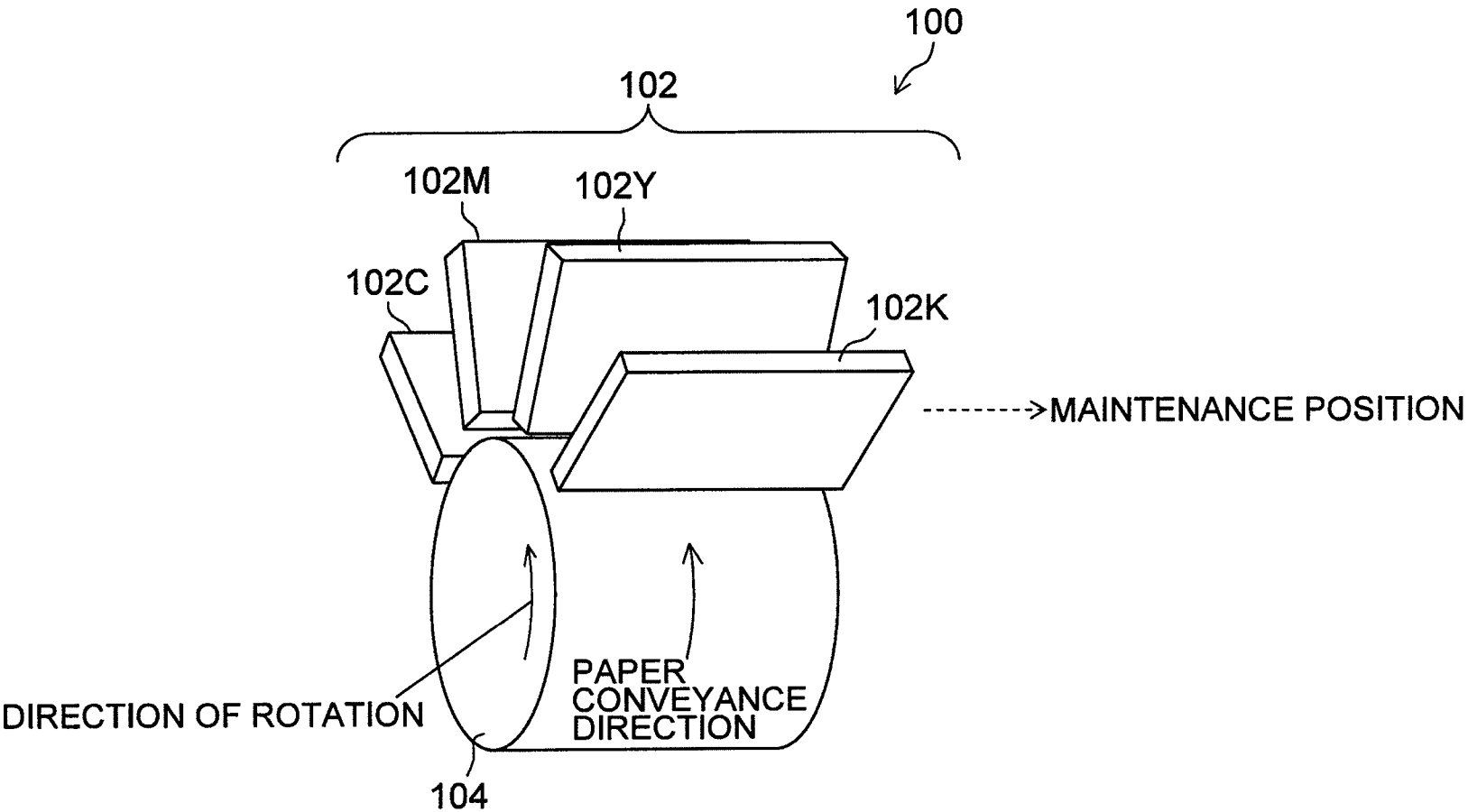
FIG. 11 is an oblique diagram illustrating the composition of the periphery of the print unit of an inkjet recording apparatus relating to an embodiment of the present invention.

FIG. 11 is a schematic drawing illustrating the general composition of the periphery of a print unit 102 in an inkjet recording apparatus 100 to which a wiping method described in the present embodiment is applied.

The inkjet recording apparatus 100 illustrated in FIG. 11 comprises a conveyance drum 104 as a device for conveying a recording medium (not illustrated). A recording medium holding region which holds a recording medium is provided on the outer circumferential surface of the conveyance drum 104.

If the conveyance drum 104 is rotated in the prescribed direction of rotation (indicated by an arrow in FIG. 11) in a state where recording medium is held on the outer circumferential surface thereof, then the recording medium is conveyed in the prescribed paper conveyance direction.

Heads 102C, 102M, 102Y and 102K corresponding to respective colors of cyan (C), magenta (M), yellow (Y) and black (K) are disposed at positions opposing the outer circumferential surface of the conveyance drum 104, from the downstream side following the paper conveyance direction. When the recording medium passes a printing region directly below the print unit 102, droplets of inks corresponding to the colors of CMYK are ejected from the heads 102C, 102M, 102Y and 102K, thereby forming a desired image.

Figure 12:
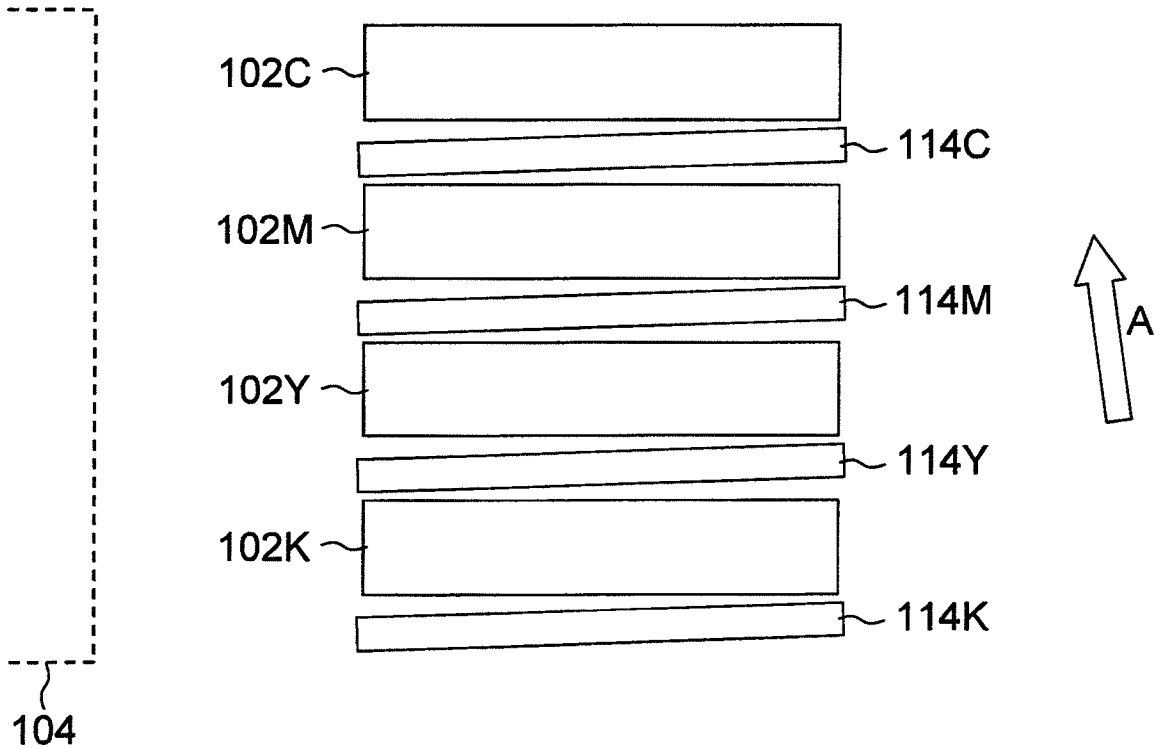
FIG. 12 is a plan diagram illustrating an example of the arrangement of a head and a blade in the maintenance position.

FIG. 12 illustrates a schematic view of a state where the heads 102C, 102M, 102Y and 102K have been withdrawn to a maintenance position. In the maintenance position illustrated in FIG. 12, maintenance processing of the heads 102C, 102M, 102Y and 102K is carried out. One example of the maintenance position is a position where the heads 102C, 102M, 102Y and 102K have been moved in parallel from the printing position opposing the conveyance drum 104.

Maintenance performed in the maintenance position includes a wiping processing performed by blades 114C, 114M, 114Y and 114K. The wiping process has been described previously, and therefore further explanation thereof is omitted here. Although not illustrated in the drawings, a desirable mode is one where a cleaning mechanism for cleaning the blades 114C, 114M, 114Y and 114K is provided after the wiping process.

The blades 114C, 114M, 114Y and 114K illustrated in FIG. 12 have a length corresponding to the length in the longitudinal direction of the heads 102C, 102M, 102Y and 102K, and are composed rotatably via rotational mechanisms so as to rotate in a prescribed range with respect to the heads 102C, 102M, 102Y and 102K, as well as being composed movably in the up/down (vertical) direction by means of a vertical movement mechanism which alters the distance with respect to the nozzle forming surface.

Moreover, the blades are also composed movably in the horizontal direction by means of a horizontal movement mechanism which moves the blades in the breadthways direction of the heads 102C, 102M, 102Y and 102K. The blades 114C, 114M, 114Y and 114K illustrated in FIG. 12 may also have a split structure.

Figure 13:
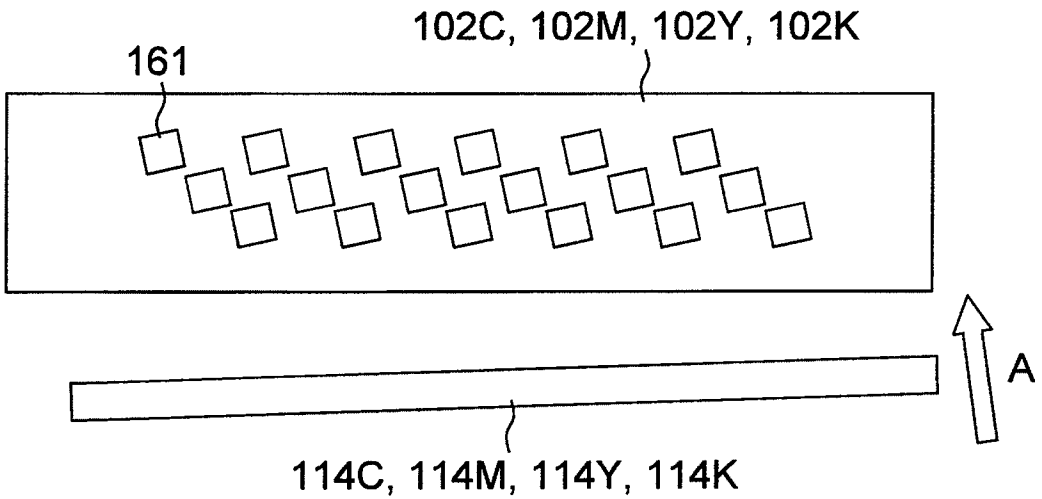
FIG. 13 is a plan diagram illustrating the head and blade illustrated in FIG. 12 viewed from the nozzle forming surface side.

FIG. 13 is a plan diagram illustrating the heads 102C, 102M, 102Y and 102K (only one head is depicted) as viewed from the nozzle forming surface side. As explained previously, if the wiping direction is set in a range of $\pm\pi/8$ (rad) with respect to the side direction of the nozzles 161 (which correspond to the nozzles 12 in FIGS. 1A and 1B), then wiping is performed simultaneously for the nozzle forming surface 10A following a substantially parallel direction to the paper conveyance direction.

Description of Nozzle Arrangement and Internal Configuration of Head

Next, the structure of the heads 102C, 102M, 102Y, 102K disposed in the print unit 102 is described in detail. The heads 102C, 102M, 102Y, 102K have a common structure, and in the following description, these heads are represented by a head denoted with reference numeral 160.

Figure 14A:
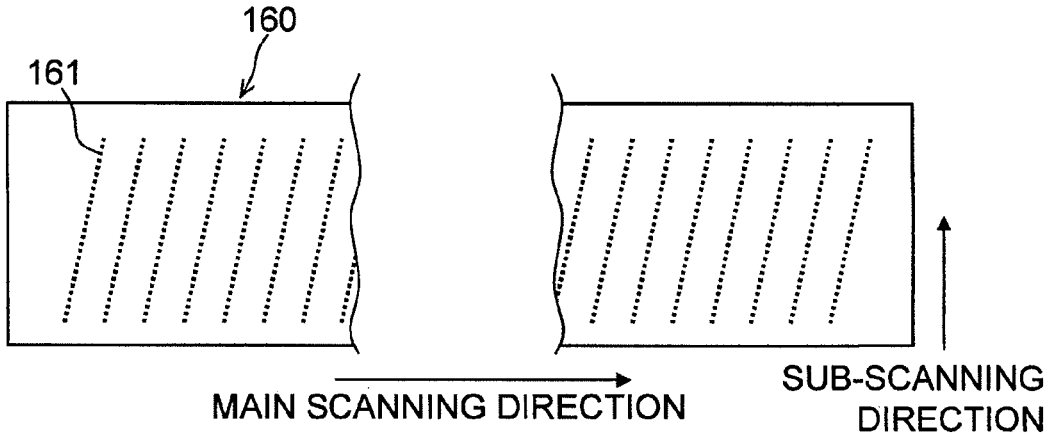
FIGS. 14A to 14D are plan diagrams illustrating examples of the arrangement of the nozzles of the head illustrated in FIGS. 11 to 13.
Figure 14B:
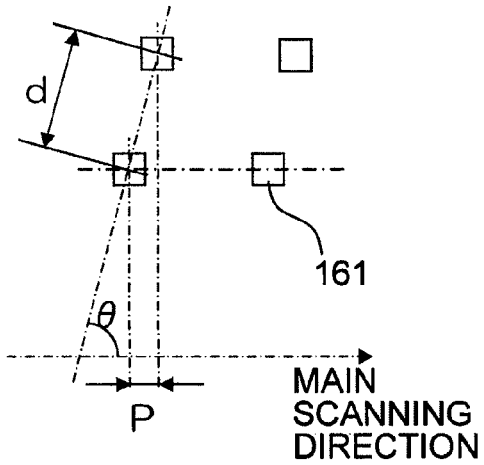

FIG. 14A is a plan view perspective diagram illustrating an example of nozzle arrangement of the head 160; FIG. 14B is an enlarged diagram illustrating a portion of the head; and FIG. 14C is a plan view perspective diagram illustrating another example of the nozzle arrangement of the head 160.

Figure 14C:
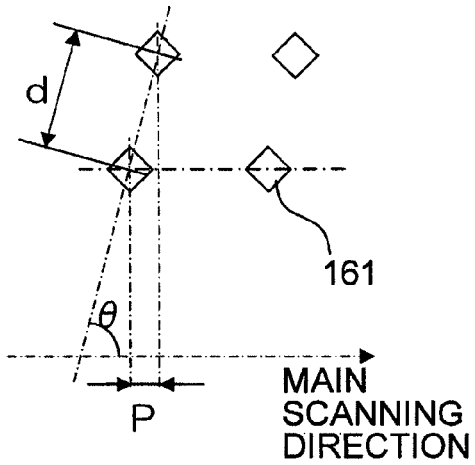
Figure 17:
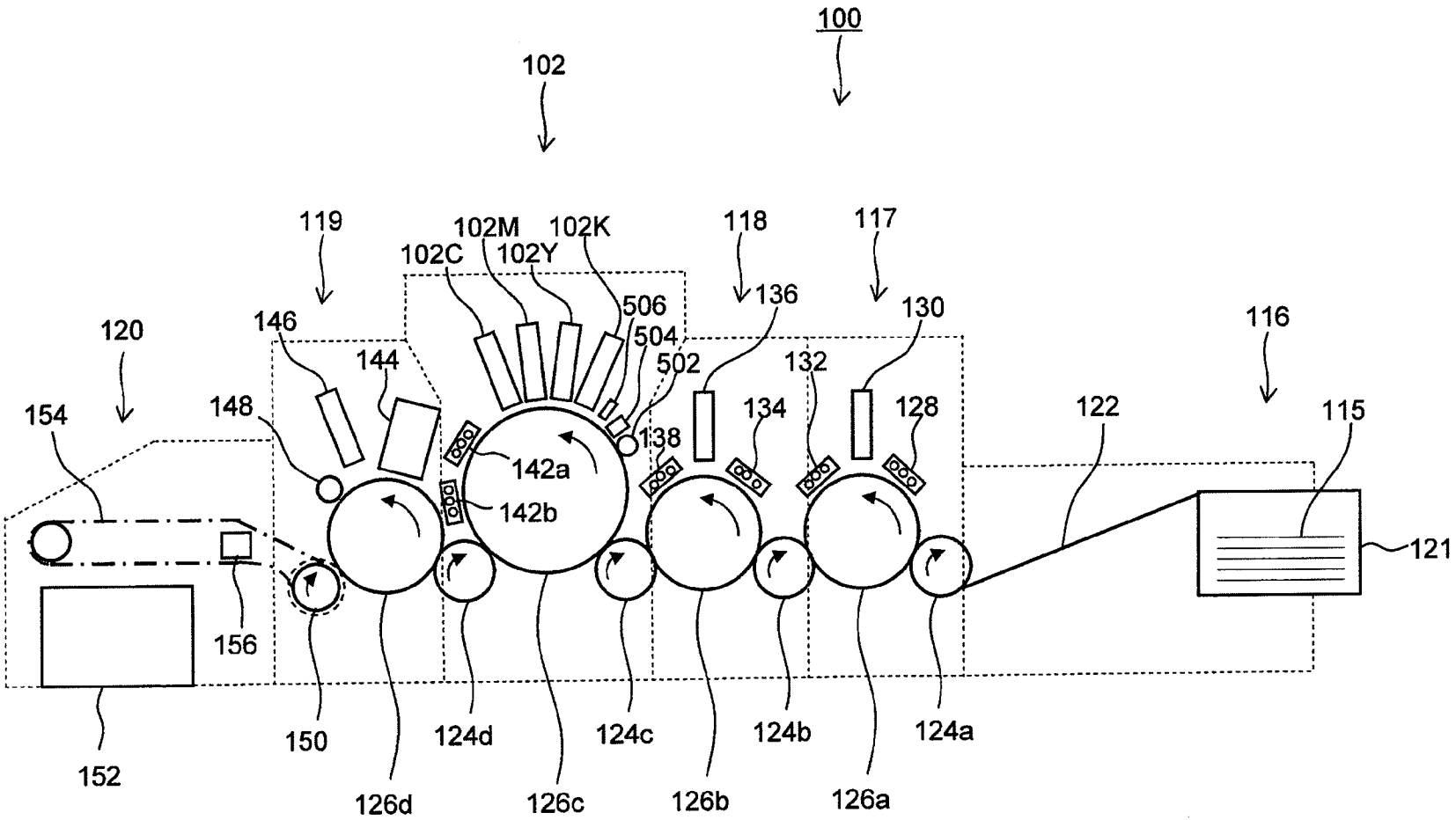
FIG. 17 is a general schematic drawing of the inkjet recording apparatus illustrated in FIG. 11 to FIG. 16.

The nozzle pitch in the head 160 should be minimized in order to maximize the density of the dots formed on the surface of the recording medium (not illustrated in FIGS. 14A-14C, but illustrated in FIG. 17 by means of reference numeral "115"). As illustrated in FIGS. 14A and 14B, the head 160 according to the present embodiment has a structure in which nozzles (see FIG. 13) forming ink droplet ejection ports are disposed two-dimensionally in the form of a staggered matrix, and hence the effective nozzle interval (the projected nozzle pitch) as projected in the longitudinal direction of the head (the main-scanning direction perpendicular to the recording medium conveyance direction (sub-scanning direction)) is reduced and high nozzle density is achieved.

Figure 14D:
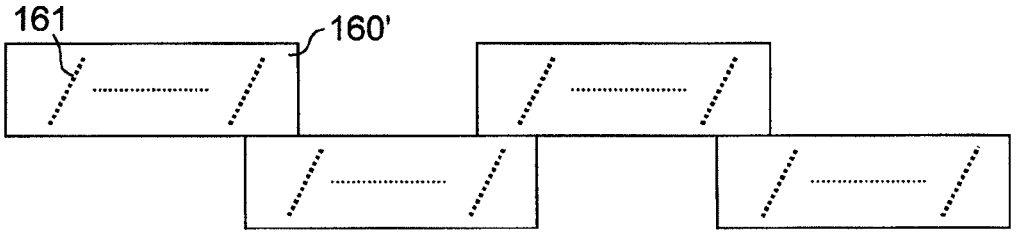

The mode of forming one or more nozzle rows through a length corresponding to the entire width of the recording area of a recording medium in a direction substantially perpendicular to the paper conveyance direction (see FIG. 11) is not limited to the embodiment described above. For example, instead of the configuration in FIG. 14A, as illustrated in FIG. 14D, a line head having the nozzle rows of the length corresponding to the entire width of the recording area of the recording medium 115 can be formed by arranging and combining, in a staggered matrix, short head blocks 160' each having a plurality of nozzles 161 arrayed two-dimensionally. Furthermore, although not illustrated in the drawings, it is also possible to compose a line head by arranging short heads in one row.

In FIGS. 14A and 14D, the individual nozzles are not depicted and the nozzle columns are depicted schematically. Furthermore, as illustrated in FIG. 14C, there is also a mode where the nozzles are formed in a direction rotated within 90° from the orientation of the nozzles 12 illustrated in FIG. 14B, and the side direction of the nozzles and the main scanning direction and the sub-scanning direction can be determined as desired.

Figure 15:
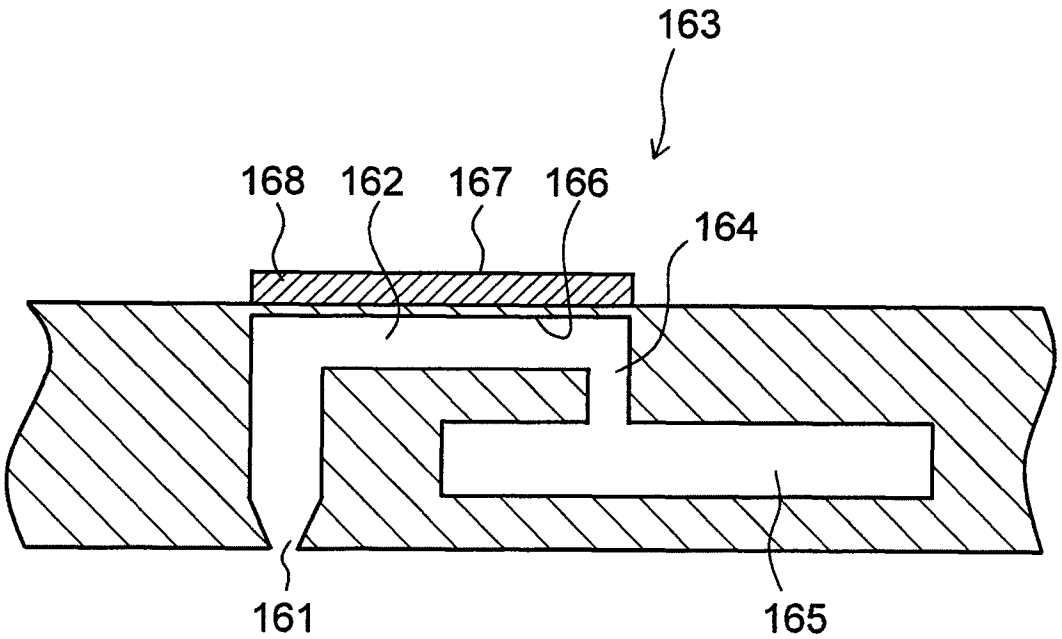
FIG. 15 is a cross-sectional diagram illustrating internal structure of the heads illustrated from FIG. 11 to FIG. 14D.

FIG. 15 is a cross sectional view of a head. As illustrated in FIG. 15, the pressure chamber 162 provided corresponding to each of the nozzles 161 is approximately square-shaped in plan view, and the nozzle 161 and a supply port 164 are arranged respectively at corners on a diagonal of the pressure chamber 162. As illustrated in FIG. 3, each pressure chamber 162 is connected through the supply port 164 to a common flow channel 165. The common flow channel 165 is connected to an ink supply tank (illustrated in FIG. 16 by means of reference numeral "170"), which is a base tank that supplies ink, and the ink supplied from the ink supply tank is delivered through the common flow channel 165 to the pressure chambers 162.

As illustrated in FIG. 15, a piezoelectric element 168 provided with an individual electrode 167 is bonded to a diaphragm 166, which forms the upper face of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As illustrated in FIG. 14B, the high-density nozzle arrangement according to the present embodiment is achieved by arranging the nozzles 161 having the above-described structure in a lattice fashion based on a fixed arrangement pattern, in a row direction that coincides with the main scanning direction, and a column direction that is inclined at a fixed angle of $\theta$ with respect to the main scanning direction, rather than being perpendicular to the main scanning direction.

More specifically, by adopting the structure in which the plurality of ink chamber units 163 are arranged at the uniform pitch d in line with the direction forming the angle of $\theta$ with respect to the main scanning direction, the pitch P of the nozzles projected so as to align in the main scanning direction is $d \times \cos\theta$, and hence the nozzles 161 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

When implementing the present invention, the arrangement structure of the nozzles is not limited to the embodiment illustrated in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium is moved in the breadthways direction (main scanning direction) of the recording medium, thereby performing printing in the breadthways direction, and when one printing action in the breadthways direction has been completed, the recording medium is moved through a prescribed amount in the sub-scanning direction perpendicular to the breadthways direction, printing in the breadthways direction of the recording medium is carried out in the next printing region, and by repeating this sequence, printing is performed over the whole surface of the printing region of the recording medium.

Configuration of Ink Supply System

Figure 16:
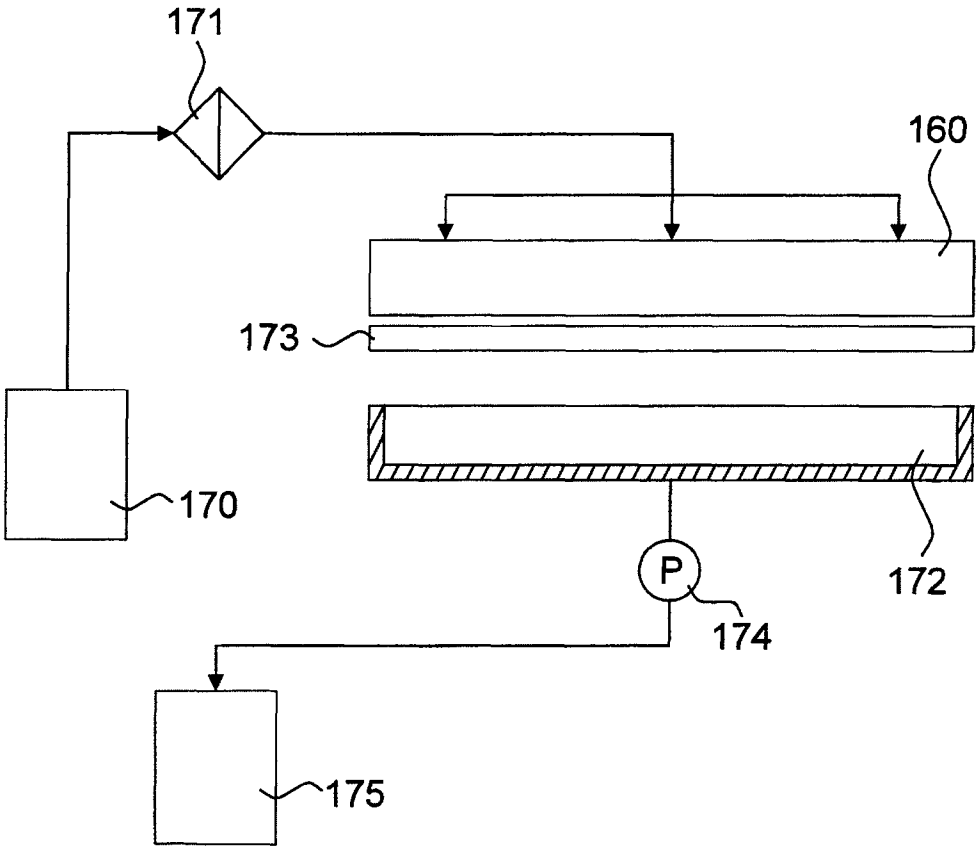
FIG. 16 is a block diagram illustrating the composition of an ink supply system of the inkjet recording apparatus illustrated in FIGS. 11 to 15.

FIG. 16 is a schematic drawing illustrating the configuration of the ink supply system in the inkjet recording apparatus 100. The ink supply tank 170 is the base tank that supplies the ink to the head 160. The aspects of the ink supply tank 170 include a refillable type and a cartridge type: when the remaining amount of ink is low, the ink tank of the refillable type is filled with ink through a filling port (not illustrated) and the ink tank of the cartridge type is replaced with a new one. In order to change the ink type in accordance with the intended application, the cartridge type is suitable, and it is desirable to represent the ink type information with a bar code or the like on the cartridge, and to perform ejection control in accordance with the ink type.

A filter 171 for removing extraneous matters and bubbles is disposed between the ink supply tank 170 and the head 160 as illustrated in FIG. 16. The filter mesh size in the filter is desirably equivalent to or less than the diameter of the nozzle and commonly about 20 μm.

Although not illustrated in FIG. 16, it is desirable to provide a sub-tank integrally to the print head 160 or nearby the head 160. The sub-tank has a damper function for preventing variation in the internal pressure of the head and a function for improving refilling of the print head.

The inkjet recording apparatus 100 is also provided with a cap 172 as a device to prevent the nozzles 161 from drying out or to prevent an increase in the ink viscosity in the vicinity of the nozzles 161, and a cleaning blade 173 (corresponding to blades 114C, 114M, 114Y and 114K illustrated in FIG. 12) as a device to clean the ink ejection surface (nozzle formation surface) of the head 160.

The head 160 is moved to a predetermined maintenance position (see FIG. 12) by means of a movement mechanism (not illustrated) when the maintenance of the head 160 is performed. The cap 172 is moved up and down relatively with respect to the head 160 by an elevator mechanism (not illustrated). When the power of the inkjet recording apparatus 100 is turned OFF or when in a print standby state, the cap 172 is raised to a predetermined elevated position so as to come into close contact with the head 160, and the nozzle face is thereby covered with the cap 172.

During printing or standby, if the use frequency of a particular nozzle 161 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 161, even if the piezoelectric element 168 (see FIG. 15) is operated.

Therefore, before a situation of this kind develops (namely, while the ink is within a range of viscosity which allows it to be ejected by operation of the piezoelectric element 168), the piezoelectric element 168 is operated, and a preliminary ejection ("purge", "blank ejection", "liquid ejection" or "dummy ejection") is carried out toward the cap 172 (ink receptacle), in order to expel the degraded ink (namely, the ink in the vicinity of the nozzle which has increased viscosity).

Furthermore, if bubbles enter into the ink inside the head 160 (inside the pressure chamber 162; see FIG. 15), then even if the piezoelectric element 168 is operated, it will not be possible to eject ink from the nozzle. In a case of this kind, the cap 172 is placed on the head 160, the ink (ink containing bubbles) inside the pressure chamber 162 is removed by suction, by means of a suction pump 174, and the ink removed by suction is then supplied to a recovery tank 175.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 162, the ink consumption is considerably large. Therefore, desirably, preliminary ejection is carried out when the increase in the viscosity of the ink is still minor.

Moreover, in a state where the head 160 has been withdrawn to the maintenance position, cleaning (wiping) of the ink ejection surface is carried out appropriately. The details of the wiping process have been described previously, and therefore further explanation thereof is omitted here.

In this way, after carrying out maintenance processing of the head 160, the head 160 is moved to a prescribed printing position and image recording onto a recording medium is carried out.

Overall Structure

Next, the overall structure of the inkjet recording apparatus 100 is described.

FIG. 17 is a general schematic drawing illustrating the general composition of an inkjet recording apparatus (image forming apparatus) 100 according to an embodiment of the present invention. The inkjet recording apparatus 100 illustrated in FIG. 17 is an on-demand type of image recording apparatus (machine for one surface) that ejects inks with a plurality of colors onto one surface of a recording medium 115 so as to record a desired color image, and is a recording device employing a two liquid aggregating system that uses ink and treatment liquid (aggregating treatment liquid) to form an image on a recording medium 115 in the shape of a sheet.

The inkjet recording apparatus 100 illustrated in FIG. 1 is a single side machine, which is capable of printing only onto one surface of a recording medium 115. The inkjet recording apparatus 100 includes: a paper supply unit 116, which supplies the recording medium 115; a permeation suppression processing unit 117, which carries out permeation suppression processing on the recording medium 115; a treatment agent deposition unit 118, which deposits treatment agent onto the recording medium 115; a print unit (ink ejection unit) 102, which forms an image by depositing the colored inks onto the recording medium 115; a fixing processing unit 119 which gives a fixing processing (treatment) to the recording medium 115 by heating and pressurizing; and a paper output unit 120, which conveys and outputs the recording medium 115 on which the image has been formed.

Although not illustrated in the drawings, one or a plurality of gripping hooks (grippers) which hold the leading end of the recording medium 115 are formed on each of the pressure drums 126*a* to 126*d* which constitute the conveyance mechanism of a recording medium 115 and the respective transfer drums 124*a* to 124*d* which are provided adjacently to the pressure drums, and transfer of the recording medium 115 is performed between the gripping hooks of the pressure drums and transfer drums.

A paper supply platform 121 on which the recording media 115 are stacked is provided in the paper supply unit 116. A feeder board 122 is connected to the front (the left-hand side in FIG. 17) of the paper supply platform 121, and the recording media 115 stacked on the paper supply platform 121 are supplied one sheet at a time, successively from the uppermost sheet, to the feeder board 122. The recording medium 115 that has been conveyed to the feeder board 122 is supplied to the surface (circumferential surface) of a pressure drum 126*a* of the permeation suppression processing unit 117 through a transfer drum 124*a* capable of rotating in the clockwise direction in FIG. 17.

Permeation Suppression Processing Unit

The permeation suppression processing unit 117 deposits permeation suppression agent which suppresses permeation into the recording medium 115 of the water and hydrophilic organic solvent contained in the treatment liquid and ink. For the permeation suppression agent, a resin dispersed in a solvent in the form of an emulsion or dissolved in a solution is used. The solvent used may be an organic solvent or water. As an organic solvent, it is possible to use methyl ethyl ketone, a petroleum material, and the like. The temperature $T_1$ of the recording paper is set to be higher than the minimum film formation temperature $T_{fl}$ of the resin. The differential between $T_{fl}$ and $T_1$ is desirably 10° C. to 20° C. By this means, after the resin has been applied to the recording medium 115, it forms a satisfactory film immediately, and therefore is able satisfactorily to suppress permeation into the recording medium 115 of the ink and treatment liquid which is subsequently deposited onto the recording medium 115. The temperature of the recording medium 115 is adjusted either by disposing a heat generating body, such as a heater, inside the pressure drum 126*a*, or by blowing a hot air flow from the surface (upper surface) of the recording medium 115, or by heating with an infrared heater, or the like, or by employing a combination of these methods.

If curling of the recording medium 115 is not liable to occur, then it is possible to omit the permeation suppression processing unit 117. For example, it is also possible to control the amount of permeation suppression agent deposited in accordance with the type of recording medium 115 (including cases where no permeation suppression agent is deposited).

The permeation suppression processing unit 117 is provided with a paper preheating unit 128, a permeation suppression agent head 130 and a permeation suppression agent drying unit 132 at positions opposing the surface of the pressure drum 126*a*, in this order from the upstream side in terms of the direction of rotation of the pressure drum 126*a* (the counter-clockwise direction in FIG. 17).

The paper preheating unit 128 and the permeation suppression agent drying unit 132 have heaters that can be temperature-controlled within prescribed ranges, respectively. When the recording medium 115 held on the pressure drum 126*a* passes through the positions opposing the paper preheating unit 128 and the permeation suppression agent drying unit 132, it is heated by the heaters of these units.

The permeation suppression agent head 130 ejects droplets of a permeation suppression agent onto the recording medium 115 that is held on the pressure drum 126*a*. The permeation suppression agent head 130 adopts the same composition as heads 102C, 102M, 102Y, 102K of the print unit 102, which is described below.

In the present embodiment, the inkjet head is used as the device for carrying out the permeation suppression processing on the surface of the recording medium 115; however, there are no particular restrictions on the device that carries out the permeation suppression processing. For example, it is also possible to use various other methods, such as a spray method, application method, or the like.

In the present embodiment, it is desirable to use a thermoplastic resin latex solution as the permeation suppression agent. Of course, the permeation suppression agent is not limited to being the thermoplastic resin latex solution, and for example, it is also possible to use lamina particles (e.g., mica), or a liquid rappelling agent (a fluoro-coating agent), or the like.

Treatment Liquid Deposition Unit

A treatment liquid deposition unit 118 is provided after the permeation suppression processing unit 117 (to the downstream side of same in terms of the direction of conveyance of the recording medium 115). A transfer drum 124*b* is arranged between the pressure drum 126*a* of the permeation suppression processing unit 117 and a pressure drum 126*b* of the treatment liquid deposition unit 118, so as to make contact with same. According to this a structure, after the recording medium 115 held on the pressure drum 126*a* of the permeation suppression processing unit 117 has been subjected to the permeation suppression processing, the recording medium 115 is transferred through the transfer drum 124*b* to the pressure drum 126*b* of the treatment liquid deposition unit 118.

The treatment liquid deposition unit 118 is provided with a paper preheating unit 134, a treatment liquid head 136 and a treatment liquid drying unit 138 at positions opposing the surface of the pressure drum 126*b*, in this order from the upstream side in terms of the direction of rotation of the pressure drum 126*b* (the counter-clockwise direction in FIG. 17).

The respective units of the treatment liquid deposition unit 118 (namely, the paper preheating unit 134, the treatment liquid head 136 and the treatment liquid drying unit 138) use similar compositions to the paper preheating unit 128, the permeation suppression agent head 130 and the permeation suppression agent drying unit 132 of the above-described permeation suppression processing unit 117, and explanation thereof is omitted here. Of course, it is also possible to employ different compositions from the permeation suppression processing unit 117.

The treatment liquid used in the present embodiment is an acidic liquid that has the action of aggregating the coloring materials contained in the inks that are ejected onto the recording medium 115 respectively from the heads 102C, 102M, 102Y, 102K disposed in the print unit 102 which is arranged at a downstream stage.

The heating temperature of a heater of the treatment liquid drying unit 138 is set to a temperature that is suitable to dry the treatment liquid having been deposited on the surface of the recording medium 115 by the ejection operation of the treatment liquid head 136 arranged to the upstream side in terms of the direction of rotation of the pressure drum 126*b*, and thereby a solid or semi-solid aggregating treatment agent layer (a thin film layer of dried treatment liquid) is formed on the recording medium 115.

The "solid or semi-solid aggregating treatment agent layer" includes a layer having a water content rate of 0% to 70%, where the water content rate is defined as:

> "Water content rate"="Weight of water contained in treatment liquid after drying, per unit surface area ($g/m^2$)"/"Weight of treatment liquid after drying, per unit surface area ($g/m^2$)".

Furthermore, the "aggregating treatment agent" involves a broad concept which includes agents in liquid form, as well as solid form or semi-solid form, and in particular an aggregating treatment agent in liquid form having a solvent content ratio of 70% or above is called an "aggregating treatment liquid".

As a method of calculating the solvent content ratio of the aggregating treatment liquid, a sheet of paper of a prescribed size (for example 100 mm×100 mm) is cut out, the total weight thereof after the deposition of the treatment liquid (the weight of the paper plus the treatment liquid before drying) and the total weight of the paper after drying of the treatment liquid (the weight of the paper plus the treatment liquid after drying) are measured respectively, and the reduction in the amount of solvent due to drying (the amount of solvent evaporated) is determined from the difference between the two weights. Furthermore, the amount of solvent contained in the treatment liquid before drying can be calculated using from the treatment liquid preparation method. It is possible to obtain the solvent content ratio from the result of these calculations.

Here, Table 1 shows the evaluation results for color movement when the solvent content rate of the treatment liquid (aggregating treatment agent layer) on the recording medium 115 is varied.

TABLE 1

| | Example 1 | Example 2 | Example 3 | Example 4 | Example 5 |
|---|---|---|---|---|---|
| Drying step | Not Exist | Exist | Exist | Exist | Exist |
| Total weight ($g/m^2$) | 10.0 | 6.0 | 4.0 | 3.0 | 1.3 |
| Weight of water ($g/m^2$) | 8.7 | 4.7 | 2.7 | 1.5 | 0 |
| Content rate of solvent | 87% | 78% | 67% | 50% | 0% |
| Movement of coloring material | Poor | Average (A little bit movement of dot) | Good (Inconspicuous in spite of dot movement) | Excellent | Excellent |

As illustrated in Table 1, if the treatment liquid is not dried (Example 1), then image deterioration occurs due to movement of the coloring material.

On the other hand, if drying of the treatment liquid is carried out (Examples 2 to 5), then the movement of the coloring material is not conspicuous when the treatment liquid is dried until a solvent content rate in the treatment liquid of 70% or lower, and movement of the coloring material assumes a satisfactory level which is virtually indiscernible by visual inspection when the treatment liquid is dried until a solvent content rate of 50% or lower. Thus, it was confirmed that that drying of the treatment liquid is effective in preventing image deterioration.

By carrying out drying until the solvent content rate on the recording medium 115 becomes 70% or lower (and desirably, 50% or lower) in this way so as to form a solid or semi-solid aggregating treatment agent layer on the recording medium 115, it is possible to prevent image deterioration caused by movement of the coloring material.

A desirable mode is one in which the recording medium 115 is preheated by the heater of the paper preheating unit 134, before depositing the treatment liquid on the recording medium 115, as in the present embodiment. In this case, it is possible to restrict the heating energy required to dry the treatment liquid to a low level, and therefore energy savings can be made.

Pringing Unit (Ink Ejection Unit)

The print unit 102 is arranged at a downstream side of the treatment liquid deposition unit 118. The transfer drum 124*c* capable of rotating in the clockwise direction in FIG. 1 is arranged between the pressure drum 126*b* of the treatment liquid deposition unit 118 and a pressure drum 126*c* of the print unit 102 (corresponding to the conveyance drum 104 in FIG. 11), so as to make contact with same. According to this structure, after the treatment liquid is deposited and the solid or semi-solid aggregating treatment agent layer is formed on the recording medium 115 that is held on the pressure drum 126*b* of the treatment liquid deposition unit 118, the recording medium 115 is transferred through the transfer drum 124*c* to the pressure drum 126*c* of the print unit 102.

A paper pressing roller 502, a paper floating sensor 504 and a paper guide 506 are provided in sequence from the upstream side in terms of the direction of rotation of the pressure drum 126*c* (the counter-clockwise direction in FIG. 17) about the periphery of the pressure drum 126*c*. The paper pressing roller 502 is a member which presses the recording medium 115 toward the pressure drum 126*c* in order to cause the recording medium 115 that has been transferred from the transfer drum 124*c* to make tight contact with the circumferential surface of the pressure drum 126*c*. The paper pressing roller 502 has a length which enables contact with the full surface of the recording medium 115 that is wound about the pressure drum 126*c* (for example, a length in the breadthways direction equivalent to the medium holding region of the pressure drum 126*c*).

The paper floating sensor 504 is a device which determines the floating up of the recording medium 115 from the circumferential surface of the pressure drum 126*c*, and although the details are described hereinafter, this sensor is constituted by a light emitter and a light receiver which are disposed in opposing positions following the axial direction of the pressure drum 126*c*.

The paper guide 506 is a guide member which restricts the floating up of the recording medium 115 from the circumferential surface of the pressure drum 126*c*, and is disposed so as to oppose the circumferential surface of the pressure drum 126*c* and extend following the drum axial line direction of the recording medium 115. Floating up of the recording medium 115 is restricted within the range of the gap (clearance) between the paper guide 506 and the circumferential surface of the pressure drum 126*c*.

Heads 102C, 102M, 102Y and 102K corresponding to the recording heads are disposed after the paper guide 506 (on the downstream side in terms of the direction of rotation of the pressure drum 126*c*). In other words, in the print unit 102, ink heads 102C, 102M, 102Y, 102K which correspond respectively to the four colors of ink, C (cyan), M (magenta), Y (yellow) and K (black), and solution drying units 142*a* and 142*b*, are provided respectively at positions opposing the surface of the pressure drum 126*c*, in this order from the upstream side in terms of the direction of rotation of the pressure drum 126*c* (the counter-clockwise direction in FIG. 17).

The heads 102C, 102M, 102Y and 102K are disposed in such a manner that the normal direction of their respective ink ejection surfaces coincides with the normal direction of the circumferential surface of the pressure drum 126*c*, and the distance between the ink ejection surfaces of the heads 102C, 102M, 102Y and 102K and the droplet ejection position on the pressure drum 126*c* (on the recording medium 115) is the same in each of the heads 102C, 102M, 102Y and 102K. By disposing the heads 102C, 102M, 102Y and 102K in an arc shape about the periphery of the pressure drum 126*c* in this way, it is possible to form a high-quality image and to ensure landing position accuracy which is governed by the droplet ejection distance.

The ink heads 102C, 102M, 102Y, 102K employ the inkjet type recording heads (inkjet heads), similarly to the permeation suppression agent head 130 and the treatment liquid head 136. The ink heads 102C, 102M, 102Y, 102K respectively eject droplets of corresponding colored inks onto the recording medium 115 held on the pressure drum 126*c*.

Moreover, although the configuration with four colors of C, M, Y and K is described in the present embodiment, the combinations of the ink colors and the number of colors are not limited to those. Light and/or dark inks, and special color inks can be added or removed as required. For example, a configuration is possible in which ink heads for ejecting light-colored inks, such as light cyan and light magenta are added, or a configuration of employing seven colors of C, M, Y, K, R, G and B is also possible. Furthermore, there is no particular restriction on the arrangement sequence of the heads of the respective colors.

Each of the solvent drying units 142*a* and 142*b* has a composition including a heater of which temperature can be controlled within a prescribed range, similarly to the paper preheating units 128 and 134, the permeation suppression agent drying unit 132, and the treatment liquid drying unit 138, which have been described above. As described hereinafter, when ink droplets are deposited onto the solid or semi-solid aggregating treatment agent layer, which has been formed on the recording medium 115, an ink aggregate (coloring material aggregate) is formed on the recording medium 115, and furthermore, the ink solvent that has separated from the coloring material spreads, so that a liquid layer containing dissolved aggregating treatment agent is formed. The solvent component (liquid component) left on the recording medium 115 in this way is a cause of curling of the recording medium 115 and also leads to deterioration of the image. Therefore, in the present embodiment, after depositing the droplets of the colored inks from the heads 102C, 102M, 102Y, 102K onto the recording medium 115, heating is carried out by the heaters of the solvent drying units 142*a* and 142*b*, and the solvent component is evaporated off and the recording medium 115 is dried.

Fixing Processing Unit

The fixing processing unit 119 is arranged at a downstream side of the print unit 102. A transfer drum 124*d* capable of rotating in the clockwise direction in FIG. 1 is arranged between the pressure drum 126*c* of the print unit 102 and a pressure drum 126*d* of the fixing processing unit 119, so as to make contact with same. Hence, after the colored inks are deposited on the recording medium 115 that is held on the pressure drum 126*c* of the print unit 102, the recording medium 115 is transferred through the transfer drum 124*d* to the pressure drum 126*d* of the fixing processing unit 119.

The fixing processing unit 119 is provided with a print determination unit (in-line sensor) 144 which reads in the print results of the print unit 102, a heater 146, and a pressurizing roller 148 at positions opposing the surface of the pressure drum 126*d*, in this order from the upstream side in terms of the direction of rotation of the pressure drum 126*d* (the counter-clockwise direction in FIG. 17).

The print determination unit 144 includes an image sensor (a line sensor, or the like), which captures an image of the print result of the print unit 102 (the droplet ejection results of the heads 102C, 102M, 102Y, 102K), and functions as a device for checking for nozzle blockages, other ejection defects and non-uniformity of the image (density non-uniformity) formed by the droplet ejection, on the basis of the droplet ejection image captured through the image sensor.

In the present example, a test pattern is formed on the image recording region or the non-image portion of the recording medium 115, the test pattern is read in by the print determination unit 144, and in-line determination is carried out, for instance, to acquire color information (colorimetry), determine density non-uniformities, judge the presence or absence of ejection abnormalities in the respective nozzles, and the like, on the basis of the reading results.

The print determination unit 144 employed in the present embodiment is constituted by a line CCD in which one row or a plurality of rows each comprising a plurality of determination elements (photoelectric transducer elements) are aligned in the breadthways direction of the recording medium 115 (or an area sensor in which a plurality of determination elements are arranged in a two-dimensional configuration), and a lens which is disposed so as to read in simultaneously the breadthways direction of the recording medium 115 by means of the line CCD (or area sensor). Instead of a line sensor having a scanning field capable of reading in the whole recordable width simultaneously, it is also possible to adopt a mode using a sensor having a narrower reading range than this, which performs reading while moving (scanning) the reading position).

The heater 146 irradiates infrared energy onto the recording medium 115, thereby curing the ink on the recording medium 115 as well as evaporating off the liquid (solvent component) on the recording medium. The recording medium 115 which has undergone a heating process by the heater 146 is subjected to a heating and fixing process by the heating roller 148. The recording medium 115 which has undergone a fixing process of the recording image by heating and pressurization in this way is sent to the paper output unit 120.

Paper Output Unit

The paper output unit 120 is arranged at a downstream side of fixing processing unit 119. The paper output unit 120 is provided with a paper output drum 150, which receives the recording medium 115 on which the droplets of the transparent UV ink have been deposited, a paper output platform 152, on which the recording media 115 are stacked, and a paper output chain 154 having a plurality of paper output grippers, which is spanned between a sprocket arranged on the paper output drum 150 and a sprocket arranged above the paper output platform 152.

FIG. 17 illustrates an embodiment of the three-liquid inkjet recording apparatus 100 including the permeation suppression processing unit 117 and the treatment liquid deposition unit 118; however, it is also possible to modify or omit these processing blocks appropriately in accordance with the properties of the ink used.

Description of Control System

Figure 18:
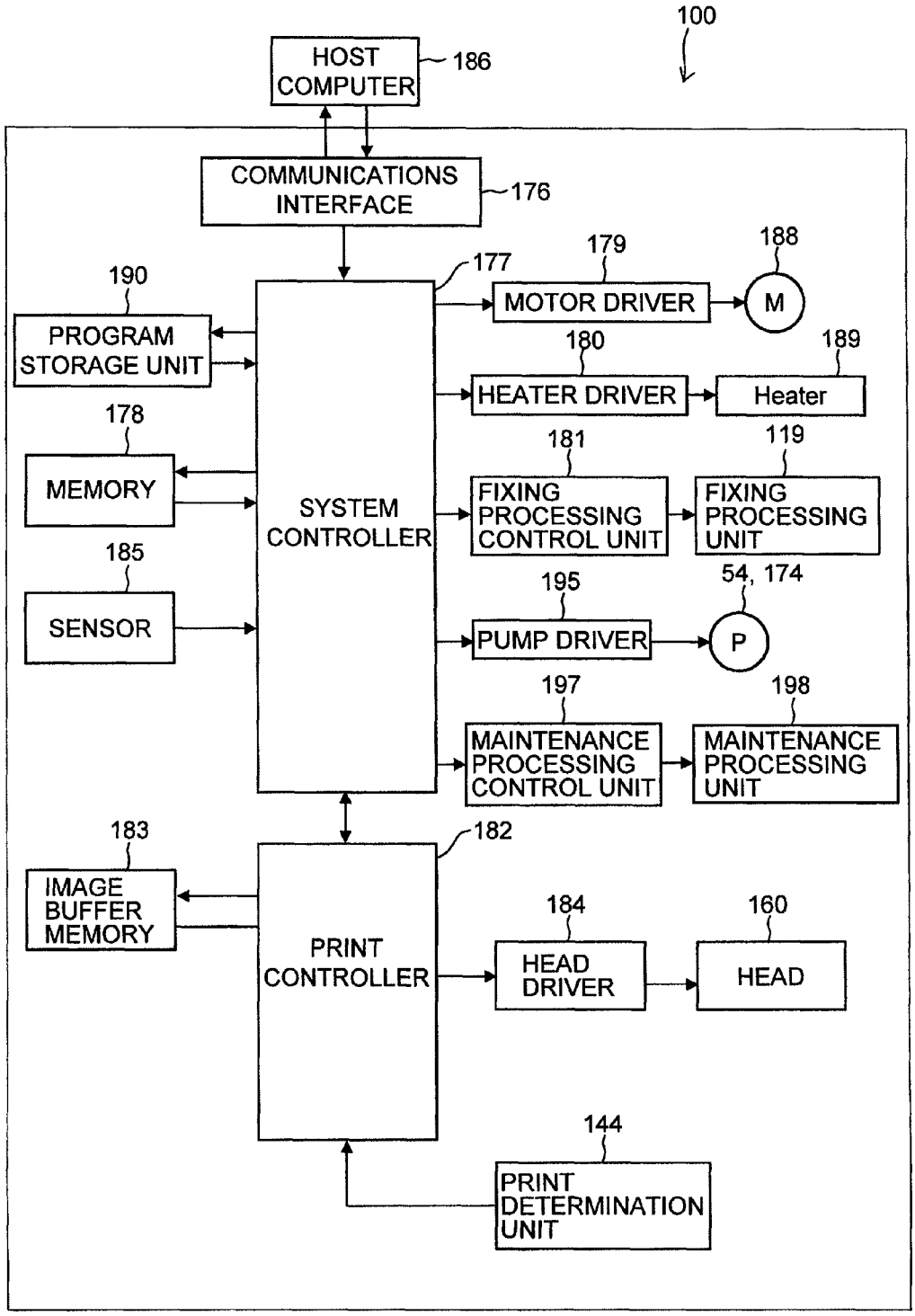
FIG. 18 is a principal block diagram illustrating a system configuration of the inkjet recording apparatus illustrated in FIG. 17.
Figure 19A:
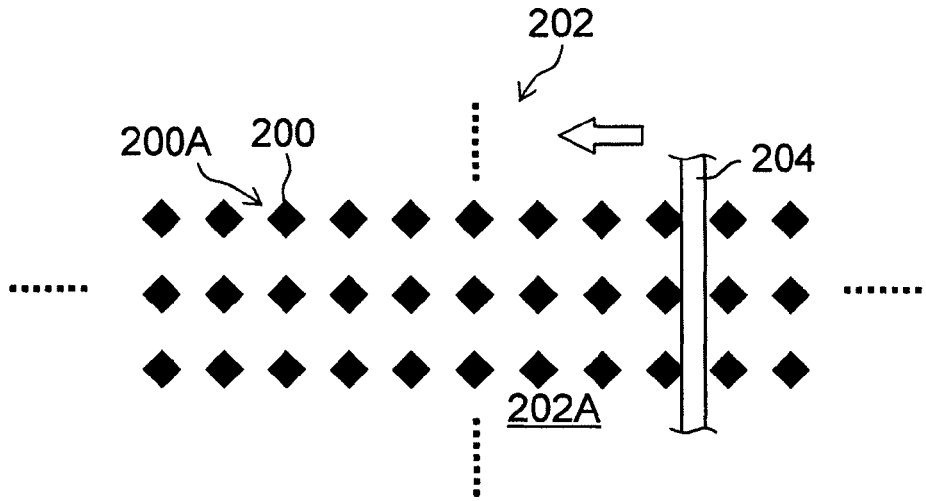
FIG.19A RELATED ART
FIGS. 19A and 19B are diagrams illustrating a wiping method according to the related art.
Figure 19B:
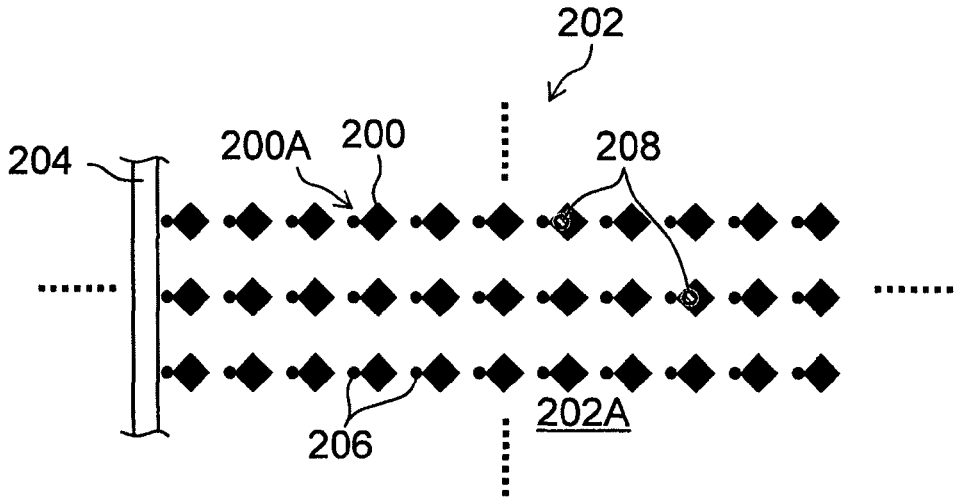
FIG.19B RELATED ART

FIG. 18 is a principal block diagram illustrating the system configuration of the inkjet recording apparatus 100. The inkjet recording apparatus 100 includes a communication interface 176, a system controller 177, a memory 178, a motor driver 179, a heater driver 180, a fixing processing controller 181, the print controller 182, an image buffer memory 183, a head driver 184, a pump driver 195, a maintenance processing controller 197, and the like.

The communication interface 176 is an interface unit for receiving image data sent from a host computer 186. A serial interface such as USB (Universal Serial Bus), IEEE1394, Ethernet, wireless network, or a parallel interface such as a Centronics interface may be used as the communication interface 176. A buffer memory (not illustrated) may be mounted in this portion in order to increase the communication speed. The image data sent from the host computer 186 is received by the inkjet recording apparatus 100 through the communication interface 176, and is temporarily stored in the memory 178.

The memory 178 is a storage device for temporarily storing image data inputted through the communication interface 176, and data is written and read to and from the memory 178 through the system controller 177. The memory 178 is not limited to a memory composed of semiconductor elements, and a hard disk drive or another magnetic medium may be used.

The system controller 177 is constituted of a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 177 controls the various sections, such as the communication interface 176, memory 178, motor driver 179, heater driver 180, and the like, as well as controlling communications with the host computer 186 and writing and reading to and from the memory 178, and it also generates control signals for controlling a motor 188, a heater 189 and a pump 196 of the conveyance system.

The program executed by the CPU of the system controller 177 and the various types of data which are required for control procedures are stored in the memory 178. The memory 178 may be a non-rewriteable storage device, or it may be a rewriteable storage device, such as an EEPROM. The memory 178 is used as a temporary storage region for the image data, and it is also used as a program development region and a calculation work region for the CPU.

Various control programs are stored in the program storage unit 190, and a control program is read out and executed in accordance with commands from the system controller 177. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not illustrated).

The motor driver 179 is a driver that drives the motor 188 in accordance with instructions from the system controller 177. In FIG. 18, the plurality of motors (actuators) disposed in the respective sections of the inkjet recording apparatus 100 are represented by the reference numeral 188. For example, the motor 188 illustrated in FIG. 18 includes motors that drive the pressure drums 126*a* to 126*d* and the transfer drums 124*a* to 124*d* (a conveyance drum 104 in FIG. 11), and the paper output drum 150 illustrated in FIG. 17, and motors of the horizontal transfer mechanism, the vertical transfer mechanism and the rotational transfer mechanism for the blade 114 illustrated in FIG. 12.

The heater driver 180 is a driver that drives the heater 189 in accordance with instructions from the system controller 177. In FIG. 18, the plurality of heaters disposed in the inkjet recording apparatus 100 are represented by the reference numeral 189. For example, the heater 189 illustrated in FIG. 18 includes the heaters of the paper preheating units 128 and 134, the permeation suppression agent drying unit 132, the treatment liquid drying unit 138, the solvent drying units 142*a* and 142*b*, and the like, illustrated in FIG. 17.

The fixing processing control unit 181 controls the on/off switching and the heating temperature of the heater 146 of the fixing processing unit 119, as well as controlling the pressure of the pressurization roller 148, and the like. When information about the type of the recording medium 115 and the image contents are acquired, the irradiation time and irradiation temperature of the heater 146 and the pressure of the pressurization roller 148 are controlled appropriately in accordance with this information.

Instead of controlling the heater 146 and the pressurization roller (or in addition to this control), it is also possible to control the speed at which the recording medium 115 is conveyed. The fixing processing control unit 181 determines the control objects accordingly, depending on the composition of the fixing processing unit 110.

The pump driver 195 controls the on/off switching and the generated pressure of the pump 196, and the like. The pump 196 in FIG. 18 includes pumps which are provided in the various sections of the apparatus, such as the pump in FIG. 10 and the suction pump 174 in FIG. 16.

The maintenance processing control unit 197 is a functional block which controls the maintenance processing unit 198 that carries out maintenance of the respective sections of the apparatus, such as the head 160 and the pressure drums 126*a* to 126*d*, on the basis of control signals sent from the system controller 177.

FIG. 18 depicts the maintenance processing unit 198 as one functional block, but the maintenance processing unit 198 is composed separately for each maintenance object, as in the maintenance processing unit of the head 160 and the maintenance processing units of the pressure drums 126*a* to 126*d*. Furthermore, the maintenance processing control unit 197 is provided for each maintenance processing unit. The maintenance processing unit 198 in FIG. 18 includes the motor 188, pump 196, and the like.

The print controller 182 has a signal processing function for performing various tasks, compensations, and other types of processing for generating print control signals from the image data stored in the memory 178 in accordance with commands from the system controller 177 so as to supply the generated print data (dot data) to the head driver 184. Prescribed signal processing is carried out in the print controller 182, and the ejection amount and the ejection timing of the ink droplets from the respective print heads 160 are controlled through the head driver 184, on the basis of the print data. By this means, desired dot size and dot positions can be achieved. In FIG. 18, the plurality of heads (inkjet heads) which are provided in the inkjet recording apparatus 100 are represented by the reference numeral 160. For example, the head 160 illustrated in FIG. 18 includes the permeation suppression agent head 130, the treatment liquid head 136, and the ink heads 102C, 102M, 102Y, 102K which are illustrated in FIG. 1.

The print controller 182 is provided with the image buffer memory 183; and image data, parameters, and other data are temporarily stored in the image buffer memory 183 when image data is processed in the print controller 182. Also possible is an aspect in which the print controller 182 and the system controller 177 are integrated to form a single processor.

The head driver 184 generates drive signals to be applied to the piezoelectric elements 168 of the head 160, on the basis of image data (dot data) supplied from the print controller 182, and includes drive circuits which drive the piezoelectric elements 168 by applying the drive signals to the piezoelectric elements 168. A feedback control system for maintaining constant drive conditions in the head 160 may be included in the head driver 184 illustrated in FIG. 18.

The print determination unit 144 is a block that includes a line sensor as described above with reference to FIG. 17, reads the image printed on the recording medium 115, determines the print conditions (presence of the ejection, variation in the dot formation, and the like) by performing prescribed signal processing, or the like, and provides the determination results of the print conditions to the print controller 182.

A desirable mode is one in which a similar composition to the print determination unit 144 (a recording medium determination sensor) is provided before the pressure drum 124*a* in FIG. 17, and the thickness and surface properties of the recording medium 115 are read in by this recording medium determination sensor, in such a manner that the type of recording medium 115 is judged on the basis of this information.

The sensor 185 indicates various sensors which are provided in the respective units of the inkjet recording apparatus 100. The sensor 185 includes a temperature sensor, a position determination sensor, a pressure sensor, and the like. The output signals of the sensor 185 are sent to the system controller 177, and the system controller 177 sends control signals to the respective units of the inkjet recording apparatus 100 on the basis of these output signals, whereby the respective units of the apparatus are controlled.

Example of Application to Other Apparatus Compositions

In the embodiment described above, an inkjet recording apparatus 100 is described as one example of an image forming apparatus, but the scope of application of embodiments of the present invention is not limited to this, and they can also be applied to industrial apparatuses which can form patterns that can be understood as images, such as resist printing apparatuses, wire printing apparatuses for electronic circuit substrates, fine structure forming apparatuses, and the like.

As has become evident from the detailed description of embodiments of the present invention given above, the present specification includes disclosure of various technical ideas including the embodiments of the invention described below.

One aspect of the present invention is directed to a maintenance method of a liquid ejection head including a nozzle forming surface where a plurality of nozzles having a polygonal planar shape including a plurality of corners which each have two sides and an angle between the two sides are formed, the maintenance method comprising the step of moving a sweep member so as to sweep the nozzle forming surface of the liquid ejection head in such a manner that the sweep member is moved in a direction making an angle within $\pi/8$ radian with respect to a direction in which any of the sides extends.

According to this aspect of the invention, when the nozzle forming surface of a liquid ejection head comprising nozzles having a polygonal planar shape is swept with a sweep member, the sweep member is moved in a substantially parallel direction to the sides of the nozzles, and therefore ink is not drawn out from the corners of the nozzles, and extraneous matter does not become mixed into the corners of the nozzles.

The direction of movement of the sweep member is desirably within $\pi/16$ radian of the direction of the sides, and more desirably, parallel to the sides.

Desirably, the sweep member is moved in a direction making a predetermined angle with respect to a direction in which the centers of the nozzles are arranged.

According to this aspect of the invention, mixing of ink drawn out from one nozzle into other nozzles is prevented.

Desirably, the direction in which the sweep member is moved is determined in such a manner that, between lines that respectively pass through opposite corners of one of the plurality nozzles in a direction parallel to the direction in which the sweep member is moved, no center of another one of the plurality nozzles is arranged.

In other words, even if a portion of the other nozzles are situated in a region corresponding to the full width of the nozzles in the direction in which the sweep member is moved, since the direction in which the sweep member is moved is set in such a manner that the centers of other nozzles are not situated in this region, then ink drawn out from one nozzle can be prevented from becoming mixed into other nozzles.

Desirably, the direction in which the sweep member is moved is determined in such a manner that, between lines that respectively pass through opposite corners of one of the plurality nozzles in a direction parallel to the direction in which the sweep member is moved, no corner of another one of the plurality nozzles is arranged.

In other words, since the direction in which the sweep member is moved is set in such a manner that the other nozzles are not situated in a region corresponding to the full width of the nozzles in the direction in which the sweep member is moved, then ink can be prevented more effectively from being drawn out from one nozzle and becoming mixed into other nozzles.

Desirably, a movement speed of the sweep member is 100 millimeter per second or less.

According to this aspect of the invention, sweeping non-uniformities are prevented.

Desirably, the direction in which the sweep member is moved is substantially parallel to a direction in which a recording medium receiving a liquid ejected from the liquid ejection head is moved.

According to this aspect of the invention, the occurrence of non-uniformities in the recorded image in the direction perpendicular to the direction of conveyance of the recording medium is prevented. This mode displays particularly beneficial effects in single-pass image recording using a full-line head.

Desirably, the sweep member is moved in non-contact with the nozzle forming surface so as to sweep the nozzle forming surface.

According to this aspect of the invention, extraneous matter, such as dirt, which has become attached to the nozzle forming surface, can be prevented from being pushed inside the nozzles.

Desirably, extraneous matter attached to the nozzle forming surface is suctioned via a suction unit formed with the sweep member.

According to this aspect of the invention, it is possible to remove ink and dirt attached to the nozzle forming surface with the movement of the sweep member.

Desirably, the liquid ejection head and the sweep member are relatively rotatable with respect to each other.

Desirably, the sweeping direction makes an angle within $\pi/16$ radian with respect to the extending direction in which any of the sides extends.

Desirably, the sweep member is moved in the sweeping direction such that projected figures of the plurality of nozzles in terms of the sweeping direction do not overlap with each other.

Another aspect of the present invention is directed to a liquid ejection apparatus comprising: a liquid ejection head that includes a nozzle forming surface where a plurality of nozzles having a polygonal planar shape including a plurality of corners which each have two sides and an angle between the two sides are formed; a sweep member for sweeping the nozzle forming surface of the liquid ejection head; and a movement device that moves the sweep member in a direction making an angle within $\pi/8$ radian with respect to a direction in which any of the sides extends.

The liquid ejection apparatus includes an inkjet recording apparatus comprising an inkjet head(s) corresponding to a plurality of colors.

A desirable mode is one where the movement device includes a rotating mechanism which rotates the sweep member, and a desirable mode is one where the movement device moves the sweep member without making contact with the liquid ejection surface. Furthermore, a desirable mode is one where a suction device which suctions adhering material attached to the nozzle forming surface is provided, the sweep member has a suction structure connecting to the suction device, and the adhering material on the nozzle forming surface is removed via the suction structure when the nozzle forming surface is swept with the sweep member.

Desirably, the nozzle forming surface is formed by a nozzle plate made of material including silicon monocrystal.

When nozzle openings are formed by wet etching in silicon monocrystal, nozzles having a substantially quadrangular planar shape are formed.

Desirably, the liquid ejection apparatus comprises a conveyance drum that is in a shape of cylinder and has a circumferential surface for conveying a recording medium while holding the recording medium, wherein the liquid ejection head is arranged in a position facing the circumferential surface of the conveyance drum.

Desirably, the liquid ejection head is a full-line head where the plurality of nozzles are arranged throughout a length corresponding to a full width of the recording medium in a direction substantially perpendicular to a direction in which the recording medium is conveyed, and the sweep member has a length corresponding to a length in a longitudinal direction of the liquid ejection head.

Desirably, the movement device includes a rotation mechanism causing a relative rotation of the liquid ejection head and the sweep member.

Desirably, the movement device causes the relative movement of the sweep member and the liquid ejection head in the sweeping direction making an angle within $\pi/16$ radian with respect to the extending direction in which any of the sides extends in such a manner that the sweep member sweeps the nozzle forming surface.

Desirably, the movement device causes the relative movement of the sweep member and the liquid ejection head in the sweeping direction such that projected figures of the plurality of nozzles in terms of the sweeping direction do not overlap with each other.

Further, the present specification discloses technical ideas including the invention below.

Another aspect of the present invention is directed to a liquid ejection apparatus comprising: a liquid ejection head having a plurality of nozzles; a sweep member to sweep a nozzle forming surface of the liquid ejection head; a movement device that moves the sweep member in a predetermined direction when the nozzle forming surface is swept by the sweep member; and a suction device that suctions extraneous matter attached to the nozzle forming surface, wherein the sweep member has a suction structure to connect to the suction device, and when the nozzle forming surface is swept by the sweep member, the extraneous matter on the nozzle forming surface is removed via the suction structure.

According to this aspect, the extraneous matter such as ink and dust attached to the nozzle forming surface can be removed along with the movement of the sweep member.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A maintenance method of a liquid ejection head including a nozzle forming surface where a plurality of nozzles are two-dimensionally arranged, each of the nozzles having a quadrangular planar shape including four corners, each of the four corners having two sides and an angle between the two sides, the maintenance method comprising the step of causing a relative movement of a sweep member and the liquid ejection head so as to sweep the nozzle forming surface of the liquid ejection head with the sweep member in such a manner that the sweep member is relatively moved in a sweeping direction, wherein the sweeping direction is determined such that:

the sweeping direction makes a non-zero angle within $\pi/8$ radian with respect to an extending direction in which one of the two sides forming one of the four corners of each of the nozzles extends, the sweep member passing the one of the four corners last among the four corners of each of the nozzles in the relative movement of the sweep member and the liquid ejection head, the extending direction being oblique to both a lengthwise direction and a breadthwise direction of the liquid ejection head;

the sweeping direction satisfies $P_D \geq D$, where $P_D$ is a distance between centers of two of the nozzles which are adjacent to each other on a same column in a direction perpendicular to the sweeping direction, and D is a dimension of each of the nozzles taken in the direction perpendicular to the sweeping direction; and if the sweeping direction does not satisfy $P_D \geq D$, then the sweeping direction satisfies $P_D > D/2$, wherein one of two diagonals of the quadrangular planar shape of each of the nozzles is parallel to the lengthwise direction of the liquid ejection head, and the other of the two diagonals is parallel to the breadthwise direction of the liquid ejection head.

2. The maintenance method as defined in claim 1, wherein the sweeping direction is determined such that the sweeping direction makes a predetermined angle with respect to a nozzle row direction in which the centers of the nozzles are arranged.

3. The maintenance method as defined in claim 2, wherein the sweeping direction is determined in such a manner that, between lines that respectively pass through opposite corners of one of the plurality nozzles in a direction parallel to the sweeping direction, no center of another one of the plurality nozzles is arranged.

4. The maintenance method as defined in claim 2, wherein the sweeping direction is determined in such a manner that, between lines that respectively pass through opposite corners of one of the plurality nozzles in a direction parallel to the sweeping direction, no corner of another one of the plurality nozzles is arranged.

5. The maintenance method as defined in claim 1, wherein a movement speed of the sweep member is 100 millimeter per second or less.

6. The maintenance method as defined in claim 1, wherein the sweeping direction is determined such that the sweeping direction is substantially parallel to a medium conveyance direction in which a recording medium receiving a liquid ejected from the liquid ejection head is moved.

7. The maintenance method as defined in claim 1, wherein the sweep member is moved in non-contact with the nozzle forming surface so as to sweep the nozzle forming surface.

8. The maintenance method as defined in claim 1, wherein extraneous matter attached to the nozzle forming surface is suctioned via a suction unit formed with the sweep member.

9. The maintenance method as defined in claim 1, wherein the liquid ejection head and the sweep member are relatively rotatable with respect to each other.

10. The maintenance method as defined in claim 1, wherein the sweeping direction is determined such that the sweeping direction makes a non-zero angle within $\pi/16$ radian with respect to the extending direction.

11. The maintenance method as defined in claim 1, wherein the sweeping direction is determined such that projected figures of the plurality of nozzles in terms of the sweeping direction do not overlap with each other.

12. A liquid ejection apparatus comprising:

a liquid ejection head that includes a nozzle forming surface where a plurality of nozzles are two-dimensionally arranged, each of the nozzles having a quadrangular planar shape including four corners, each of the four corners having two sides and an angle between the two sides;

a sweep member for sweeping the nozzle forming surface of the liquid ejection head; and a movement device that causes a relative movement of the sweep member and the liquid ejection head so as to sweep the nozzle forming surface of the liquid ejection head with the sweep member in such a manner that the sweep member is relatively moved in a sweeping direction, wherein the sweeping direction is determined such that:

the sweeping direction makes a non-zero angle within $\pi/8$ radian with respect to an extending direction in which one of the two sides forming one of the four corners of each of the nozzles extends, the sweep member passing the one of the four corners last among the four corners of each of the nozzles in the relative movement of the sweep member and the liquid ejection head, the extending direction being oblique to both a lengthwise direction and a breadthwise direction of the liquid ejection head;

the sweeping direction satisfies $P_D \geq D$, where $P_D$ is a distance between centers of two of the nozzles which are adjacent to each other on a same column in a direction perpendicular to the sweeping direction, and D is a dimension of each of the nozzles taken in the direction perpendicular to the sweeping direction; and if the sweeping direction does not satisfy $P_D \geq D$, then the sweeping direction satisfies $P_D > D/2$, wherein one of two diagonals of the quadrangular planar shape of each of the nozzles is parallel to the lengthwise direction of the liquid ejection head, and the other of the two diagonals is parallel to the breadthwise direction of the liquid ejection head.

13. The liquid ejection apparatus as defined in claim 12, wherein the nozzle forming surface is formed by a nozzle plate made of material including silicon monocrystal.

14. The liquid ejection apparatus as defined in claim 12, comprising a conveyance drum that is in a shape of cylinder and has a circumferential surface for conveying a recording medium while holding the recording medium, wherein the liquid ejection head is arranged in a position facing the circumferential surface of the conveyance drum.

15. The liquid ejection apparatus as defined in claim 14, wherein:

the liquid ejection head is a full-line head where the plurality of nozzles are arranged throughout a length corresponding to a full width of the recording medium in a direction substantially perpendicular to a medium conveyance direction in which the recording medium is conveyed, and the sweep member has a length corresponding to a length in a longitudinal direction of the liquid ejection head.

16. The liquid ejection apparatus as defined in claim 12, wherein the movement device includes a rotation mechanism causing a relative rotation of the liquid ejection head and the sweep member.

17. The liquid ejection apparatus as defined in claim 12, wherein the sweeping direction makes a non-zero angle within $\pi/16$ radian with respect to the extending direction.

18. The liquid ejection apparatus as defined in claim 12, wherein the sweeping direction is determined such that projected figures of the plurality of nozzles in terms of the sweeping direction do not overlap with each other.

19. The maintenance method as defined in claim 1, wherein one of two diagonals of the quadrangular planar shape of each of the nozzles is parallel to a nozzle row direction in which the centers of the nozzles are arranged.

20. The liquid ejection apparatus as defined in claim 12, wherein one of two diagonals of the quadrangular planar shape of each of the nozzles is parallel to a nozzle row direction in which the centers of the nozzles are arranged.

* * * * *